US012465110B2

(12) United States Patent
Beers et al.

(10) Patent No.: US 12,465,110 B2
(45) Date of Patent: Nov. 11, 2025

(54) CONTROL DEVICE FOR AN ARTICLE OF FOOTWEAR

(71) Applicant: NIKE, Inc., Beaverton, OR (US)

(72) Inventors: Tiffany A. Beers, Portland, OR (US); Andrew A. Owings, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/104,295

(22) Filed: Aug. 17, 2018

(65) Prior Publication Data

US 2019/0082772 A1 Mar. 21, 2019

Related U.S. Application Data

(63) Continuation of application No. 14/724,007, filed on May 28, 2015, now Pat. No. 10,070,681.

(51) Int. Cl.

| | |
|---|---|
| ***A43B 3/00*** | (2022.01) |
| ***A41D 1/00*** | (2018.01) |
| ***A41D 27/20*** | (2006.01) |
| ***A43B 3/34*** | (2022.01) |
| ***A43B 3/36*** | (2022.01) |
| ***A43C 11/16*** | (2006.01) |

(52) U.S. Cl.

CPC ..... *A43B 3/34* (2022.01); *A41D 1/002* (2013.01); *A41D 27/205* (2013.01); *A43B 3/36* (2022.01); *A43C 11/165* (2013.01)

(58) Field of Classification Search

CPC ..... A43B 3/0005

See application file for complete search history.

(56) References Cited

U.S. PATENT DOCUMENTS

| | | | | |
|---|---|---|---|---|
| 1,702,583 A * | 2/1929 | Williams | A43B 7/04 219/211 |
| 4,466,204 A | 8/1984 | Wu | |
| 4,848,009 A | 7/1989 | Rodgers | |
| 5,032,705 A * | 7/1991 | Batcheller | A41D 13/0051 219/211 |
| 5,345,700 A * | 9/1994 | Norment | A43B 3/0078 36/136 |
| 5,530,626 A * | 6/1996 | Norment | A43B 3/0078 174/521 |

(Continued)

FOREIGN PATENT DOCUMENTS

| | | |
|---|---|---|
| CN | 2749113 | 12/2005 |
| CN | 103025189 | 4/2013 |

(Continued)

OTHER PUBLICATIONS

NPL (Translation JP 2005342076 A) (Year: 2005).*

(Continued)

*Primary Examiner* — Jila M Mohandesi
(74) *Attorney, Agent, or Firm* — Quinn IP Law

(57) ABSTRACT

An article of footwear or an article of apparel can include provisions for facilitating the installation of a control device. The control device can include a panel comprising a plurality of buttons that can provide manual control to a user. The control device can be installed in a compartment within the article after initial manufacture of the article of footwear. In some cases, the control device can be used to perform different functions in a motorized tensioning system.

7 Claims, 15 Drawing Sheets

(56) References Cited

U.S. PATENT DOCUMENTS

| | | | | |
|---|---|---|---|---|
| 5,537,763 | A | 7/1996 | Donnadieu et al. | |
| 5,592,759 | A | 1/1997 | Cox | |
| 5,623,772 | A * | 4/1997 | Sunderland | A43B 3/0031 219/211 |
| 5,673,499 | A * | 10/1997 | Attilieni | A43B 1/0036 36/137 |
| 5,765,300 | A | 6/1998 | Kianka | |
| 5,791,068 | A | 8/1998 | Bernier et al. | |
| 5,836,899 | A | 11/1998 | Reilly | |
| 5,947,580 | A * | 9/1999 | Chien | A43B 3/0005 362/84 |
| 5,956,866 | A * | 9/1999 | Spears | A43B 3/0057 36/2.6 |
| D433,758 | S * | 11/2000 | Allen | A43B 1/0036 D2/905 |
| 6,691,433 | B2 | 2/2004 | Liu | |
| 6,694,643 | B1 | 2/2004 | Hsu | |
| 6,788,200 | B1 | 9/2004 | Jamel et al. | |
| 7,210,253 | B2 | 5/2007 | Yu | |
| 7,225,565 | B2 | 6/2007 | Dibenedetto et al. | |
| 7,254,910 | B2 * | 8/2007 | Guzman | A43B 1/0027 36/136 |
| 7,302,764 | B2 * | 12/2007 | Harris | A43B 3/0005 36/140 |
| 7,514,641 | B2 * | 4/2009 | Kohatsu | H01H 3/12 200/341 |
| 7,596,891 | B2 | 10/2009 | Carnes et al. | |
| 7,607,243 | B2 | 10/2009 | Berner et al. | |
| 7,714,709 | B1 * | 5/2010 | Daniel | A43B 3/00 340/539.11 |
| 7,789,520 | B2 | 9/2010 | Konig et al. | |
| 7,794,101 | B2 | 9/2010 | Galica et al. | |
| 7,941,943 | B2 * | 5/2011 | Baker | A43B 23/26 36/54 |
| 8,056,269 | B2 | 11/2011 | Beers et al. | |
| 8,058,837 | B2 | 11/2011 | Beers et al. | |
| 8,086,421 | B2 | 12/2011 | Case, Jr. et al. | |
| 8,234,798 | B2 | 8/2012 | Dibenedetto | |
| 8,384,551 | B2 | 2/2013 | Ross et al. | |
| 8,628,453 | B2 | 1/2014 | Balakrishnan et al. | |
| 8,771,148 | B2 | 7/2014 | Balakrishnan et al. | |
| 8,879,685 | B2 | 11/2014 | Oshio | |
| 8,935,860 | B2 | 1/2015 | Torres | |
| 8,938,892 | B2 | 1/2015 | Case, Jr. | |
| 9,375,053 | B2 | 6/2016 | Burns et al. | |
| 10,070,681 | B2 | 9/2018 | Beers et al. | |
| 2003/0070324 | A1 | 4/2003 | Nelson | |
| 2004/0088887 | A1 | 5/2004 | Kim | |
| 2006/0156588 | A1 | 7/2006 | Ferrell | |
| 2007/0113564 | A1 | 5/2007 | Whitney et al. | |
| 2007/0130804 | A1 | 6/2007 | Levy et al. | |
| 2008/0203144 | A1 | 8/2008 | Kim | |
| 2008/0301919 | A1 * | 12/2008 | Ussher | A43B 3/0005 24/712.7 |
| 2009/0272013 | A1 * | 11/2009 | Beers | A43B 1/0054 36/137 |
| 2009/0288317 | A1 * | 11/2009 | Forbes | A43B 3/00 36/136 |
| 2010/0223816 | A1 | 9/2010 | Barfield | |
| 2011/0054359 | A1 | 3/2011 | Sazonov et al. | |
| 2011/0107771 | A1 | 5/2011 | Crist et al. | |
| 2011/0175744 | A1 | 7/2011 | Englert et al. | |
| 2011/0225843 | A1 | 9/2011 | Kerns et al. | |
| 2011/0260857 | A1 | 10/2011 | Hamill | |
| 2011/0266384 | A1 | 11/2011 | Goodman et al. | |
| 2012/0000091 | A1 | 1/2012 | Cotterman et al. | |
| 2012/0234111 | A1 | 9/2012 | Molyneux et al. | |
| 2013/0019694 | A1 | 1/2013 | Molyneux et al. | |
| 2013/0130843 | A1 | 5/2013 | Burroughs et al. | |
| 2013/0211290 | A1 | 8/2013 | Lee | |
| 2013/0219754 | A1 | 8/2013 | Nowak et al. | |
| 2013/0312293 | A1 | 11/2013 | Gerber | |
| 2014/0057233 | A1 | 2/2014 | Morag et al. | |
| 2014/0068838 | A1 | 3/2014 | Beers et al. | |
| 2014/0070042 | A1 | 3/2014 | Beers et al. | |
| 2014/0082963 | A1 | 3/2014 | Beers | |
| 2014/0228987 | A1 | 8/2014 | Case, Jr. et al. | |
| 2014/0244009 | A1 | 8/2014 | Mestas | |
| 2014/0249660 | A1 | 9/2014 | Prstojevich | |
| 2014/0277632 | A1 | 9/2014 | Walker | |
| 2014/0330409 | A1 | 11/2014 | Case, Jr. et al. | |
| 2014/0358472 | A1 | 12/2014 | Goel et al. | |
| 2015/0059204 | A1 | 3/2015 | Alexander et al. | |
| 2015/0096204 | A1 | 4/2015 | Case, Jr. | |
| 2015/0104772 | A1 | 4/2015 | Goel et al. | |
| 2016/0345655 | A1 | 12/2016 | Beers et al. | |

FOREIGN PATENT DOCUMENTS

| | | | |
|---|---|---|---|
| CN | 203692654 | U | 7/2014 |
| CN | 104582519 | | 4/2015 |
| CN | 107920618 | A | 4/2018 |
| CN | 107920618 | B | 2/2022 |
| CN | 114451626 | | 5/2022 |
| EP | 0221483 | A2 | 5/1987 |
| EP | 2253238 | A1 | 11/2010 |
| EP | 3302125 | | 10/2023 |
| JP | H0613502 | U | 2/1994 |
| JP | 2000316623 | A | 11/2000 |
| JP | 2002119498 | A | 4/2002 |
| JP | 2005342076 | A * | 12/2005 |
| JP | 2008204380 | A | 9/2008 |
| JP | 2011519611 | A | 7/2011 |
| JP | 2013509964 | A | 3/2013 |
| JP | 2018516123 | A | 6/2018 |
| JP | 2022133272 | | 9/2022 |
| JP | 7361160 | | 10/2023 |
| JP | 7373893 | | 10/2023 |
| KR | 930001920 | B1 | 3/1993 |
| KR | 2019940001499 | Y1 | 3/1994 |
| KR | 20210095724 | | 8/2021 |
| KR | 102497979 | | 2/2023 |
| KR | 20230025495 | | 2/2023 |
| KR | 102621465 | | 1/2024 |
| WO | WO-0078170 | A1 | 12/2000 |
| WO | WO-2014036371 | A1 | 3/2014 |
| WO | WO-2014153433 | A2 | 9/2014 |
| WO | WO-2016191125 | A1 | 12/2016 |

OTHER PUBLICATIONS

"Chinese Application Serial No. 201680044189.1, Office Action mailed Jan. 21, 2020", w Concise Statement of Relevance, 10 pgs.

"Chinese Application Serial No. 201680044189.1, Response filed Aug. 3, 20 to Office Action mailed Jan. 21, 2020", w/ English claims, 36 pgs.

"Japanese Application Serial No. 2017-561685, Notification of Reasons for Refusal mailed Jun. 16, 2020", w/ English translation, 8 pgs.

"Korean Application Serial No. 10-2017-7037072, Notice of Preliminary Rejection mailed Sep. 14, 2020", w/ English translation, 23 pgs.

"Chinese Application Serial No. 201680044189.1, Office Action mailed Mar. 31, 2021", w/o English Translation, 7 pgs.

"Chinese Application Serial No. 201680044189.1, Office Action mailed Sep. 29, 2020", with English translation, 12 pages.

"Chinese Application Serial No. 201680044189.1, Response filed Feb. 7, 2021 to Office Action mailed Sep. 29, 2020", w/ Current English Claims, 6 pgs.

"European Application Serial No. 16729096.4, Communication Pursuant to Article 94(3) EPC mailed Mar. 9, 2021", 9 pgs.

"Japanese Application Serial No. 2017-561685, Notification of Reasons for Refusal mailed May 11, 2021", No. English translation, 2 pgs.

"Japanese Application Serial No. 2017-561685, Response filed Nov. 27, 2020 to Notification of Reasons for Refusal mailed Jun. 16, 2020", w/ English claims, 8 pgs.

"Korean Application Serial No. 10-2017-7037072, Response filed Feb. 15, 2021 to Notice of Preliminary Rejection malled Sep. 14, 2020", w/ English Claims, 19 pgs.

(56) References Cited

OTHER PUBLICATIONS

"U.S. Appl. No. 14/724,007, Examiner Interview Summary mailed Apr. 23, 2018", 3 pgs.
"U.S. Appl. No. 14/724,007, Final Office Action mailed Feb. 22, 2018", 17 pgs.
"U.S. Appl. No. 14/724,007, Non Final Office Action mailed Aug. 25, 2017", 11 pgs.
"U.S. Appl. No. 14/724,007, Notice of Allowability mailed Jun. 5, 2018", 2 pgs.
"U.S. Appl. No. 14/724,007, Notice of Allowance mailed May 11, 2018", 5 pgs.
"U.S. Appl. No. 14/724,007, PTO Response to Rule 312 Communication mailed Jul. 23, 2018", 2 pgs.
"U.S. Appl. No. 14/724,007, Response filed Jun. 16, 17 to Restriction Requirement mailed Apr. 18, 2017", 6 pgs.
"U.S. Appl. No. 14/724,007, Response filed Dec. 22, 2017 to Non Final Office Action maled Aug. 25, 2017", 8 pgs.
"U.S. Appl. No. 14/724,007, Restriction Requirement mailed Apr. 18, 2017", 6 pgs.
"U.S. Appl. No. 14/724,007, Response Filed 423-2018 to Final Office Action mailed Feb. 22, 2018", 7 pgs.
"International Application Serial No. PCT/US2016/032283, International Preliminary Report on Patentability mailed Dec. 7, 2017", 8 pgs.
"International Application Serial No. PCT/US2016/032283, International Search Report mailed Sep. 13, 2016", 14 pgs.
"International Application Serial No. PCT/US2016/032283, Written Opinion mailed Sep. 13, 2016", 14 pgs.
"European Application Serial No. 16729096.4, Response filed Jul. 27, 2018 to Communication Pursuant to Rules 161 and 162 EPC mailed Jan. 17, 2018", 16 pgs.
"European Application Serial No. 16729096.4, Communication Pursuant to Article 94(3) EPC mailed Nov. 11, 2021", 6 pgs.
"Japanese Application Serial No. 2017-561685, Examiners Decision of Final Refusal mailed Feb. 1, 2022", w/ English translation, 4 pgs.
"Korean Application Serial No. 10-2017-7037072, Notice of Near Conclusion of Trial Examination mailed Oct. 29, 2021".
"Korean Application Serial No. 10-2021-7023333, Notice of Preliminary Rejection mailed Feb. 7, 2022", W/English Translation, 13 pgs.
"Japanese Application Serial No. 2017-561685, Response filed Jun. 1, 2022 to Examiners Decision of Final Refusal mailed Feb. 1, 2022", w English claims, 8 pgs.
"Japanese Application Serial No. 2022-089727, Voluntary Amendment filed Jun. 27, 2022", w English claims, 10 pgs.
"Korean Application Serial No. 10-2017-7037072, Final Office Action mailed Jun. 22, 2021", With English translation, 8 pages.
"Chinese Application Serial No. 201680044189.1, Response filed Jul. 30, 2021 to Office Action mailed Mar. 31, 2021", With English claims, 35 pages.
"European Application Serial No. 16729096.4, Response filed Jul. 19, 2021 to Communication Pursuant to Article 94(3) EPC mailed Mar. 9, 2021", 12 pages.
"Korean Application Serial No. 10-2017-7037072, Appeal filed Jul. 22, 2021 to Final Office Action mailed Jun. 22, 2021", With current English claims, claims not amended in appeal filed, 19 pages.
"Chinese Application Serial No. 201680044189.1, Response filed Sep. 14, 2021 to Examiner Telephone Interview", w English claims, 32 pgs.
"Korean Application Serial No. 10-2021-7023333, Response filed Jul. 5, 2022 to Notice of Preliminary Rejection mailed Feb. 7, 2022", w English claims, 17 pgs.
"Japanese Application Serial No. 2017-561685, Notification of Reasons for Refusal mailed Apr. 25, 2023", w English Translation, 4 pgs.
"European Application Serial No. 16729096.4, Response filed May 17, 2022 to Communication Pursuant to Article 94(3) EPC mailed Nov. 11, 2021", 18 pgs.
"Japanese Application Serial No. 2017-561685, Response filed Jul. 21, 2023 to Notification of Reasons for Refusal mailed Apr. 25, 2023", w English claims, 7 pgs.
"European Application Serial No. 23201402.7, Response Filed Dec. 19, 2023 to Invitation to Remedy Deficiencies (R.58 EPC) mailed on Oct. 13, 2023", 5 pgs.
"Chinese Application Serial No. 202210116357.0, Office Action mailed Feb. 29, 2024", W English Translation, 9 pgs.
"European Application Serial No. 23201402.7, Extended European Search Report mailed Apr. 15, 2024", 11 pgs.
"Chinese Application Serial No. 202210116357.0, Response filed Aug. 29, 2024 to Office Action mailed Feb. 29, 2024", w English claims, 29 pgs.
"Chinese Application Serial No. 202210116357.0, Office Action mailed Nov. 16, 2024", W English Translation, 12 pgs.
"European Application Serial No. 23201402.7, Response filed Nov. 14, 2024 to Extended European Search Report mailed Apr. 15, 2024", 24 pgs.
"Chinese Application Serial No. 202210116357.0, Response filed Mar. 17, 2025 to Office Action mailed Nov. 16, 2024", w English claims, 29 pgs.
"Chinese Application Serial No. 202210116357.0, Office Action mailed Mar. 26, 2025", With English Machine Translation, 10 pgs.

* cited by examiner

CONTROL DEVICE FOR AN ARTICLE OF FOOTWEAR

BACKGROUND

The present embodiments relate generally to articles of footwear and methods of manufacturing an article of footwear.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. Likewise, some articles of apparel may include various kinds of closure systems for adjusting the fit of the apparel.

SUMMARY

In one aspect, the present disclosure is directed to an article of footwear, comprising an upper and a sole structure, and a control device, where the control device comprises a panel. The upper has a first surface and a second surface, where a compartment is formed between a portion of the first surface and a portion of the second surface. The first surface also has one or more apertures, where the one or more apertures include a first aperture. The panel includes one or more buttons, the one or more buttons including a first button, and where the panel is disposed within the compartment. Furthermore, the first button is aligned with the first aperture.

In another aspect, the present disclosure is directed to an article of apparel, comprising a first surface and a second surface, where the first surface comprises a separate portion of material from the second surface. The article of apparel also has a control device, where the control device comprises a panel. A compartment is formed between the first surface and the second surface, where the first surface has one or more apertures, and the one or more apertures include a first aperture. The panel also includes one or more buttons, the one or more buttons including a first button. The panel is disposed within the compartment such that the first button is exposed through the first aperture.

In another aspect, the present disclosure is directed to a method of installing a control device in an article of footwear, comprising associating the control device with an interior void of an upper within the article of footwear, and inserting an edge of a panel of the control device into a slot formed within a portion of the upper. The method further includes moving the panel through the slot such that the panel is disposed within a compartment formed in the upper, and aligning at least one button disposed on the panel with at least one aperture formed on the upper.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
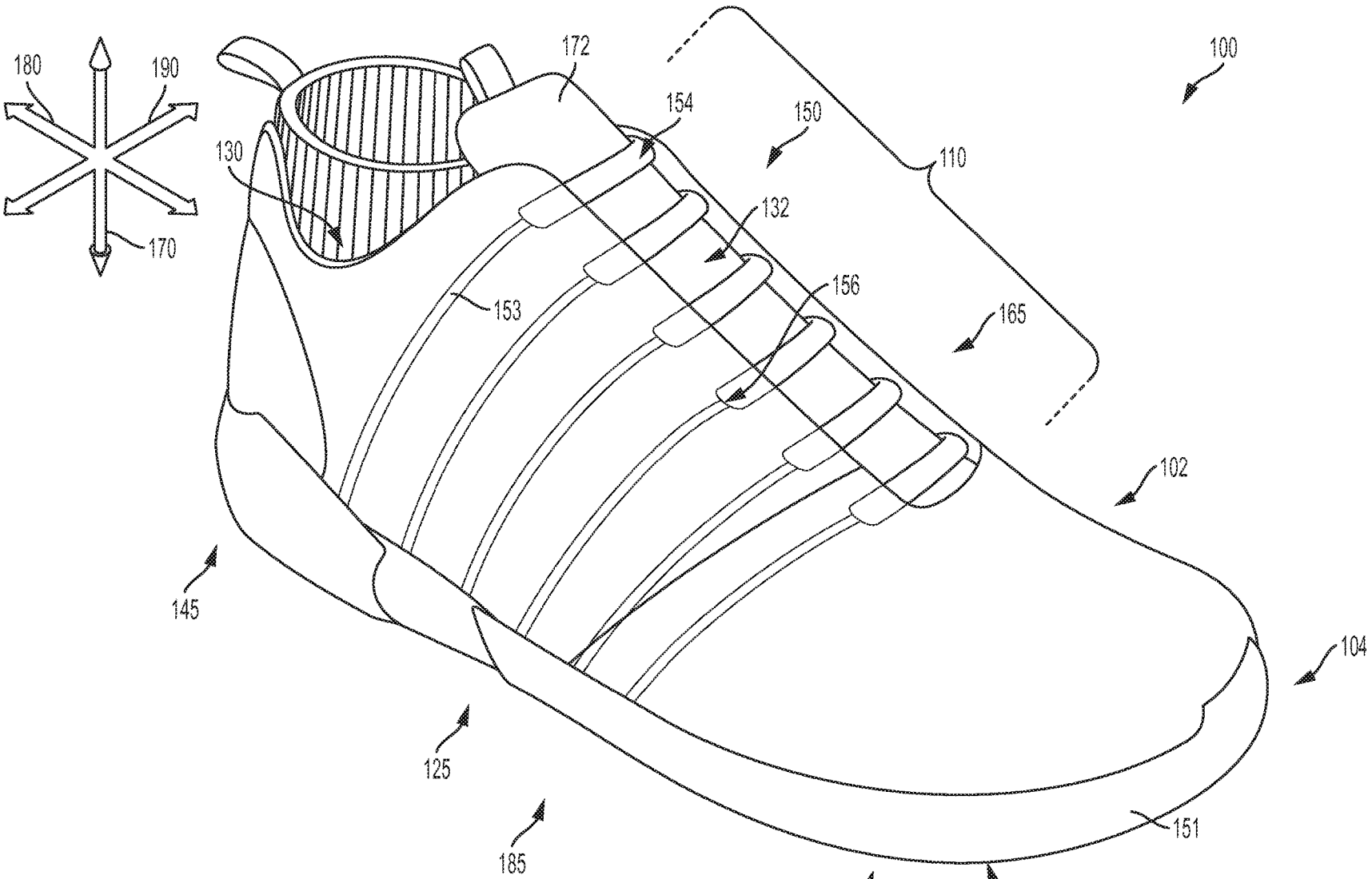
FIG. 1 is a schematic isometric side view of an embodiment of an article of footwear.

The following discussion and accompanying figures disclose articles of footwear and a method of assembly of an article of footwear. Concepts associated with the footwear disclosed herein may be applied to a variety of athletic footwear types, including running shoes, basketball shoes, soccer shoes, baseball shoes, football shoes, and golf shoes, for example. Accordingly, the concepts disclosed herein apply to a wide variety of footwear types.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal," as used throughout this detailed description and in the claims, refers to a direction extending a length of a component. For example, a longitudinal direction of an article of footwear extends between a forefoot region and a heel region of the article of footwear. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a component. In other words, the lateral direction may extend between a medial side and a lateral side of an article of footwear, with the lateral side of the article of footwear being the surface that faces away from the other foot, and the medial side being the surface that faces toward the other foot.

The term "side," as used in this specification and in the claims, refers to any portion of a component facing generally in a lateral, medial, forward, or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The "interior" of a shoe refers to space that is occupied by a wearer's foot when the shoe is worn. The "inner side" of a panel or other shoe element refers to the face of that panel or element that is (or will be) oriented toward the shoe interior in a completed shoe. The "outer side" or "exterior" of an element refers to the face of that element that is (or will be) oriented away from the shoe interior in the completed shoe. In some cases, the inner side of an element may have other elements between that inner side and the interior in the completed shoe. Similarly, an outer side of an element may have other elements between that outer side and the space external to the completed shoe. Further, the terms "inward" and "inwardly" shall refer to the direction toward the interior of the shoe, and the terms "outward" and "outwardly" shall refer to the direction toward the exterior of the shoe.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" or "removably inserted" shall refer to the joining of two components or a component and an element in a manner such that the two components are secured together, but may be readily detached from one another. Examples of removable attachment mechanisms may include hook and loop fasteners, friction fit connections, interference fit connections, threaded connectors, cam-locking connectors, compression of one material with another, and other such readily detachable connectors.

FIG. 1 illustrates a schematic isometric view of an embodiment of article of article 100 that is configured with a tensioning system 150. In the current embodiment, article of article 100, also referred to hereafter simply as article 100, is shown in the form of an athletic shoe, such as a running shoe. However, in other embodiments, tensioning system 150 may be used with any other kind of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear. As discussed in further detail below, a tensioning system may not be limited to footwear and in other embodiments a tensioning system and/or components associated with a tensioning system could be used with various kinds of apparel, including clothing, sportswear, sporting equipment and other kinds of apparel. In still other embodiments, a tensioning system may be used with braces, such as medical braces.

As noted above, for consistency and convenience, directional adjectives are employed throughout this detailed description. Article 100 may be divided into three general regions along a longitudinal axis 180: a forefoot region 105, a midfoot region 125, and a heel region 145. Forefoot region 105 generally includes portions of article 100 corresponding with the toes and the joints connecting the metatarsals with the phalanges. Midfoot region 125 generally includes portions of article 100 corresponding with an arch area of the foot. Heel region 145 generally corresponds with rear portions of the foot, including the calcaneus bone. Forefoot region 105, midfoot region 125, and heel region 145 are not intended to demarcate precise areas of article 100. Rather, forefoot region 105, midfoot region 125, and heel region 145 are intended to represent general relative areas of article 100 to aid in the following discussion. Since various features of article 100 extend beyond one region of article 100, the terms forefoot region 105, midfoot region 125, and heel region 145 apply not only to article 100, but also to the various features of article 100.

Referring to FIG. 1, for reference purposes, a lateral axis 190 of article 100, and any components related to article 100, may extend between a medial side 165 and a lateral side 185 of the foot. Additionally, in some embodiments, longitudinal axis 180 may extend from forefoot region 105 to a heel region 145. It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190.

Article 100 may include upper 102 and sole structure 104. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

As shown in FIG. 1, upper 102 may include one or more material elements (for example, meshes, textiles, foam, leather, and synthetic leather), which may be joined to define an interior void configured to receive a foot of a wearer. The material elements may be selected and arranged to selectively impart properties such as light weight, durability, air-permeability, wear-resistance, flexibility, and comfort. Upper 102 may define a opening 130 through which a foot of a wearer may be received into the interior void.

At least a portion of sole structure 104 may be fixedly attached to upper 102 (for example, with adhesive, stitching, welding, or other suitable techniques) and may have a configuration that extends between upper 102 and the ground. Sole structure 104 may include provisions for attenuating ground reaction forces (that is, cushioning and stabilizing the foot during vertical and horizontal loading). In addition, sole structure 104 may be configured to provide traction, impart stability, and control or limit various foot motions, such as pronation, supination, or other motions.

In some embodiments, sole structure 104 may be configured to provide traction for article 100. In addition to providing traction, sole structure 104 may attenuate ground reaction forces when compressed between the foot and the ground during walking, running or other ambulatory activities. The configuration of sole structure 104 may vary significantly in different embodiments to include a variety of conventional or non-conventional structures. In some cases, the configuration of sole structure 104 can be configured according to one or more types of ground surfaces on which sole structure 104 may be used.

For example, the disclosed concepts may be applicable to footwear configured for use on any of a variety of surfaces, including indoor surfaces or outdoor surfaces. The configuration of sole structure 104 may vary based on the properties and conditions of the surfaces on which article 100 is anticipated to be used. For example, sole structure 104 may vary depending on whether the surface is harder or softer. In addition, sole structure 104 may be tailored for use in wet or dry conditions.

In some embodiments, sole structure 104 may be configured for a particularly specialized surface or condition. The proposed footwear upper construction may be applicable to any kind of footwear, such as basketball, soccer, football, and other athletic activities. Accordingly, in some embodiments, sole structure 104 may be configured to provide traction and stability on hard indoor surfaces (such as hardwood), soft, natural turf surfaces, or on hard, artificial turf surfaces. In some embodiments, sole structure 104 may be configured for use on multiple different surfaces.

As will be discussed further below, in different embodiments, sole structure 104 may include different components. For example, sole structure 104 may include an outsole, a midsole, a cushioning layer, and/or an insole. In addition, in some cases, sole structure 104 can include one or more cleat members or traction elements that are configured to increase traction with a ground surface.

In some embodiments, sole structure 104 may include multiple components, which may individually or collectively provide article 100 with a number of attributes, such as support, rigidity, flexibility, stability, cushioning, comfort, reduced weight, or other attributes. In some embodiments, sole structure 104 may include an insole/sockliner, a midsole 151, and a ground-contacting outer sole member ("outsole") 162, which may have an exposed, ground-contacting lower surface. In some cases, however, one or more of these components may be omitted. In on embodiment, sole structure 104 may comprise a sole plate, as will be further discussed below.

Furthermore, in some embodiments, an insole may be disposed in the void defined by upper 102. The insole may extend through each of forefoot region 105, midfoot region 125, and heel region 145, and between lateral side 185 and medial side 165 of article 100. The insole may be formed of a deformable (for example, compressible) material, such as polyurethane foams, or other polymer foam materials. Accordingly, the insole may, by virtue of its compressibility, provide cushioning, and may also conform to the foot in order to provide comfort, support, and stability.

Midsole 151 may be fixedly attached to a lower area of upper 102, for example, through stitching, adhesive bonding, thermal bonding (such as welding), or other techniques, or may be integral with upper 102. Midsole 151 may be formed from any suitable material having the properties described above, according to the activity for which article 100 is intended. In some embodiments, midsole 151 may include a foamed polymer material, such as polyurethane (PU), ethyl vinyl acetate (EVA), or any other suitable material that operates to attenuate ground reaction forces as sole structure 104 contacts the ground during walking, running, or other ambulatory activities.

Midsole 151 may extend through each of forefoot region 105, midfoot region 125, and heel region 145, and between lateral side 185 and medial side 165 of article 100. In some embodiments, portions of midsole 151 may be exposed around the periphery of article 100, as shown in FIG. 1. In other embodiments, midsole 151 may be completely covered by other elements, such as material layers from upper 102. For example, in some embodiments, midsole 151 and/or other portions of upper 102 may be disposed adjacent to a bootie (see FIGS. 3 and 4).

Furthermore, as shown in FIG. 1, article 100 may include a tongue 172, which may be provided near or along a throat opening 132. In some embodiments, tongue 172 may be provided in or near an instep region 110 of article 100. However, in other embodiments, tongue 172 may be disposed along other portions of an article of footwear, or an article may not include a tongue.

In addition, as noted above, in different embodiments, article 100 may include a tensioning system 150. Tensioning system 150 may comprise various components and systems for adjusting the size of an opening 130 leading to an interior void (see FIG. 2) and tightening (or loosening) upper 102 around a wearer's foot. In some embodiments, tensioning system 150 may comprise one or more laces, as well as a motorized tensioning device. A lace may be configured to pass through various lacing guides 154, which may be further associated with the edges of a throat opening 132. In some cases, lacing guides 154 may provide a similar function to traditional eyelets on uppers. In particular, as a lace is pulled or tensioned, throat opening 132 may generally constrict so that upper 102 is tightened around a foot.

The arrangement of lacing guides 154 in FIG. 1 is only intended to be exemplary and it will be understood that other embodiments are not limited to a particular configuration for lacing guides 154. Furthermore, the particular types of lacing guides 154 illustrated in the embodiments are also exemplary and other embodiments may incorporate any other kinds of lacing guides or similar lacing provisions. In some other embodiments, for example, laces could be inserted through traditional eyelets. Some examples of lace guiding provisions that may be incorporated into the embodiments are disclosed in Cotterman et al., U.S. Patent Application Publication Number 2012/0000091, published Jan. 5, 2012 and entitled "Lace Guide," the disclosure of which is incorporated herein by reference in its entirety. Additional examples are disclosed in Goodman et al., U.S. Patent Application Publication Number 2011/0266384, published Nov. 3, 2011 and entitled "Reel Based Lacing System", the disclosure of which is incorporated herein by reference in its entirety. Still additional examples of lace guides are disclosed in Kerns et al., U.S. Patent Application Publication Number 2011/0225843, published Sep. 22, 2011 and entitled "Guides For Lacing Systems," the disclosure of which is incorporated herein by reference in its entirety.

A lace as used with article 100 may comprise any type of type of lacing material known in the art. Examples of laces that may be used include cables or fibers having a low modulus of elasticity as well as a high tensile strength. A lace may comprise a single strand of material, or can comprise multiple strands of material. An exemplary material for the lace is SPECTRA™, manufactured by Honeywell of Morris Township NJ, although other kinds of extended chain, high modulus polyethylene fiber materials can also be used as a lace. Still further exemplary properties of a lace can be found in the Reel Based Lacing Application mentioned above.

Thus, in some embodiments, a lace may be passed through lacing guides 154. In other embodiments, a lace may pass through internal channels 153 within upper 102 after entering channel openings 156 that are near lacing guides 154. In some embodiments, internal channels 153 extend around the sides of upper 102 and guide the lace towards a motorized tensioning device disposed in sole structure 104. In some cases, the motorized tensioning device may include provisions for receiving portions of a lace. In some cases, end portions of the lace can exit internal channels 153 of upper 102 and can pass through apertures in a housing unit that contains a motorized tensioning device.

In some embodiments, a motorized tensioning device may generally be configured to automatically apply tension to a lace for purposes of tightening and loosening upper 102. A motorized tensioning device may thus include provisions for winding a lace onto, and unwinding a lace from, a spool internal to the motorized tensioning device. Moreover, the provisions may include an electric motor that automatically winds and unwinds the spool in response to various inputs or controls.

Figure 2:
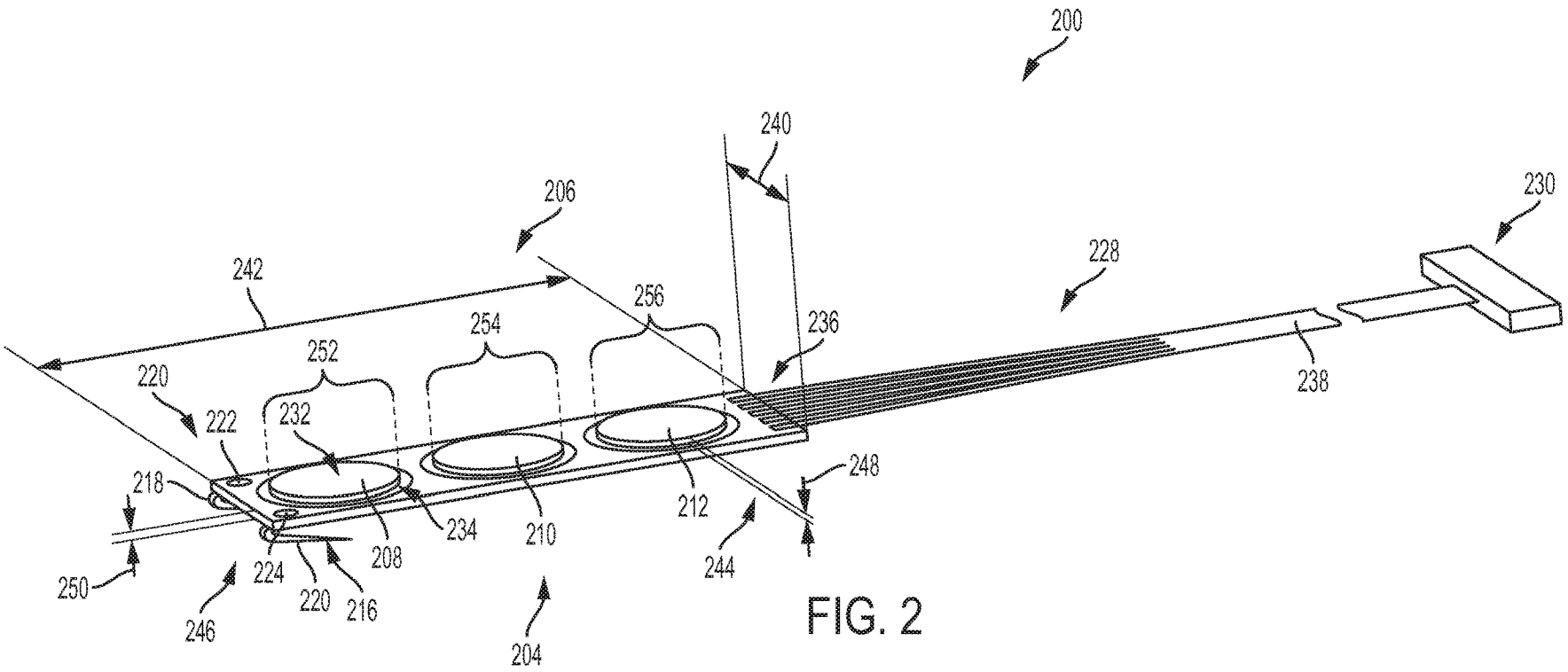
FIG. 2 is a schematic view of an embodiment of a control device.

In different embodiments, control of a motorized lacing system or other electrical or automated features in an article can be accomplished using various processes and apparatuses. As noted above with respect to FIG. 1, some embodiments of article 100 may utilize various kinds of devices for sending or transmitting commands to a motorized tensioning or lacing system or other mechanisms. Referring now to FIG. 2, various articles may utilize different kinds of devices for sending commands to systems associated with the article. In some embodiments, an article can include a control device 200.

In some embodiments, the control device may include various buttons, switches, mechanisms or components that can be utilized for measuring current, pressure, or other properties in article 100. In different embodiments, the control device may include components or elements that can detect and measure a relative change in a force or applied load, detect and measure the rate of change in force, identify force thresholds and/or detect contact and/or touch.

Thus, in different embodiments, an article may include provisions for managing, commanding, directing, activating, or otherwise regulating the functions of other devices or systems. In FIG. 2, control device 200 comprises a control unit depicted as a button board or a panel 204. In some embodiments, panel 204 may comprise a substantially flat or two-dimensional material or structure. The term "two-dimensional" as used throughout this detailed description and in the claims refers to any generally flat material exhibiting a length and width that are substantially greater than a thickness of the material. Although two-dimensional materials may have smooth or generally untextured surfaces, some two-dimensional materials will exhibit textures or other surface characteristics, such as dimpling, protrusions, ribs, or various patterns, for example. In other embodiments, the geometry of panel 204 could vary and could include various contours or features associated with parts of a foot, for example, the instep region of a foot.

Panel 204 may further have different dimensions and/or shapes in different embodiments. In FIG. 2, buttons 206 are disposed along a substantially continuous, rectangular-shaped and relatively narrow strip comprising panel 204. However, in other embodiments, the dimensions and/or shape of panel 204 may differ, including but not limited to oblong, square, oval, elliptical, or other regular or irregular shapes. In FIG. 2, it can be seen that panel 204 has a panel width 240 and a panel length 242. Panel length 242 extends from a first end 246, to a second end 244. In some embodiments, second end 244 is associated with region of panel 204 joined to lead wires 236, while first end 246 is associated with a substantially free (unattached) end of panel 204.

Furthermore, panel 204 includes a first thickness 250. First thickness 250 may be generally consistent throughout panel 204, or may vary. In addition, panel width 240, panel length 242, and/or first thickness 250 may be configured for insertion in a compartment within an article, as will be discussed below with respect to FIGS. 3-10.

Referring to FIG. 2, in some embodiments, control device 200 may include one or more buttons 206 disposed along panel 204. Buttons 206 could be used for manually inputting or entering commands to any type of system or other mechanism. As described with respect to motorized tensioning system 150, in some embodiments, buttons 206 could be used in initiating incremental tightening and incremental loosening commands, for example. In other embodiments, additional buttons can be included for initiating any other commands including an open command (or fully loosen command), store tension command and return to stored tension command. Still other embodiments could incorporate any other buttons for issuing any other kinds of commands. In different embodiments, buttons for tightening laces, loosening laces and/or performing other functions can be located directly on or in an article. For purposes of this disclosure, buttons refer to a material or element that can be pressed or otherwise handled to operate a mechanism, such as a button, switch, knob, control, lever, handle, or other such control means.

Furthermore, in different embodiments, buttons 206 can be mechanically configured such that a bottom side of each button has a female mating portion that grasps and engages with a corresponding male mechanical connector disposed on panel 204. In some embodiments, the inner surface of a button can include an actuating projection designed to press the piezo-electric or solenoid button located within panel 204. In other embodiments, buttons 206 can incorporate or utilize any other means of generating a signal known in the art.

As noted above, in some embodiments, panel 204 may include one or more buttons 206. In FIG. 2, panel 204 includes a first button 208, a second button 210, and a third button 212. However, in other embodiments, panel 204 may comprise any desired object or element, and/or any number of buttons. Furthermore, each button may include an inner portion 232 and an outer portion 234. Inner portion 232 may be associated with the primary contact or reactive portion of a button, generally disposed closer to the center of a button. Outer portion 234 may bound or otherwise frame inner portion 232, and provide stability and resilience to buttons 206.

Buttons 206 may include different shapes and/or sizes in different embodiments. For example, buttons 206 may be round, square, triangular, or other regular or irregular shape. Furthermore, two or more buttons 206 may comprise substantially similar shapes, or each button may be different from another. As an example, first button 208 may be round-shaped, while second button 210 may be square-shaped, and third button 212 may be triangular-shaped.

In FIG. 2, each button is substantially round-shaped. In one embodiment, inner portion 232 of each of buttons 206 can be associated with a diameter. For example, first button 208 has a first diameter 252, second button 210 has a second diameter 254, and third button 212 has a third diameter 256. In some embodiments, first diameter 252, second diameter 254, and third diameter 256 may be substantially similar, as shown in FIG. 2, such that buttons 206 are generally uniform in size across panel 204. Inner portion 232 of each button may also include a second thickness 248, which can be associated with the height of a button that occurs or is disposed to extend above outer portion 234. It should be understood that second thickness 248 associated with a button may change or decrease when the button is depressed, as will be discussed with respect to FIGS. 11-13. Furthermore, in different embodiments, first button 208, second button 210, and third button 212 may each comprise varying button thicknesses with respect to one another.

In other embodiments, first diameter 252, second diameter 254, and third diameter 256 may differ, for example, to provide visual or tactile feedback to a user regarding a particular button. In some cases, buttons 206 may be shaped or dimensioned differently to provide tactile or visual feedback to a user. In other embodiments, there may be a desired design or aesthetic that can be formed as a result of varying button shapes or sizes. Furthermore, each button diameter and/or thickness may be configured to align with other components or portions of an article, as will be discussed further below with respect to FIGS. 5-10.

Furthermore, panel 204 may include provisions to facilitate the insertion or incorporation of control device 200 in an article. In some embodiments, panel 204 may include one or more apertures or holes to permit control device 200 to be linked or pulled. For example, in FIG. 2, panel 204 has a first hole 222 and a second hole 224. In different embodiments, first hole 222 and/or second hole 224 can be grasped or used to loop other elements in order to help move or configure control device 200 to the desired location in article 100. In one embodiment, a wire or other tensile element can be used to grasp first hole 222 and/or second hole 224 to pull panel 204 through compartment 302 during installation of control device 200.

Furthermore, control device 200 can include provisions to allow control device 200 to be anchored or secured within an article. For example, panel 204 may include one or more hook portions 216, including a first hook portion 218 and a second hook portion 220. Hook portions 216 can comprise curved or bent material, and may be disposed along any portion of control device 200. In FIG. 2, hook portions 216 are disposed along first end 246 of panel 204. In some embodiments, hook portions 216 can be used to catch hold of another element, and/or for securing and/or anchoring panel 204 within an article, as will be discussed below.

Control device 200 may also include provisions for connecting panel 204 to other elements. For example, there may be a connecting portion 228 disposed to extend between panel 204 and a port 230. In some embodiments, connecting portion 228 may include a sheath 238 that encases one or more wires. In FIG. 2, second end 244 of panel 204 is joined to lead wires 236, which are encased in sheath 238. Lead wires 236 (and sheath 238) may be varying lengths in different embodiments, and may be adjusted depending on the compartment and/or article that control device 200 will be installed in. In addition, in one embodiment, connecting portion 228 includes port 230. In some embodiments, port 230 can provide a link or contact portion with an additional element, such as various mechanical or electronic contacts associated with an article.

Furthermore, in some embodiments, panel 204 and other components of control device 200 may comprise various material compositions. In some embodiments, panel 204 can be associated with a higher stiffness or hardness than upper 102. In one embodiment, portions of control device 200 including buttons 206 and panel 204 can be at least partially formed of a plastic or metal material, a polymer, and/or a polymeric material. The materials used in the manufacture of control device 200 may be selected based on providing the component with improved electrical or insulation properties, flexibility, resilience, weight, durability, and/or energy-efficiency.

It should be understood that the embodiments described herein with respect to control device 200 may be applicable for use with articles that do not include a tensioning system. In other words, control device 200 may be utilized in any type or configuration of footwear or article of apparel.

As noted with respect to FIG. 1 above, in different embodiments, article 100 may include aspects, portions, and/or components traditionally included in an article of footwear, such as upper 102 or sole structure 104. In the present disclosure, other non-traditional aspects, portions and/or components may also be included during the manufacture of article 100. In some embodiments, such non-traditional features may include one or more compartments disposed throughout various portions of article 100. For purposes of this disclosure, a compartment refers to a separate or distinct section or portion of article 100. In some embodiments, a compartment can include a sleeve-like region, a tunnel or tubing disposed within article 100, and/or a recess, cavity, pocket, chamber, slot, pouch, or other space configured to receive an object, element, or component. In some embodiments, during manufacture of article 100, one or more compartments can be included in article 100, as will be discussed below.

Figure 3:
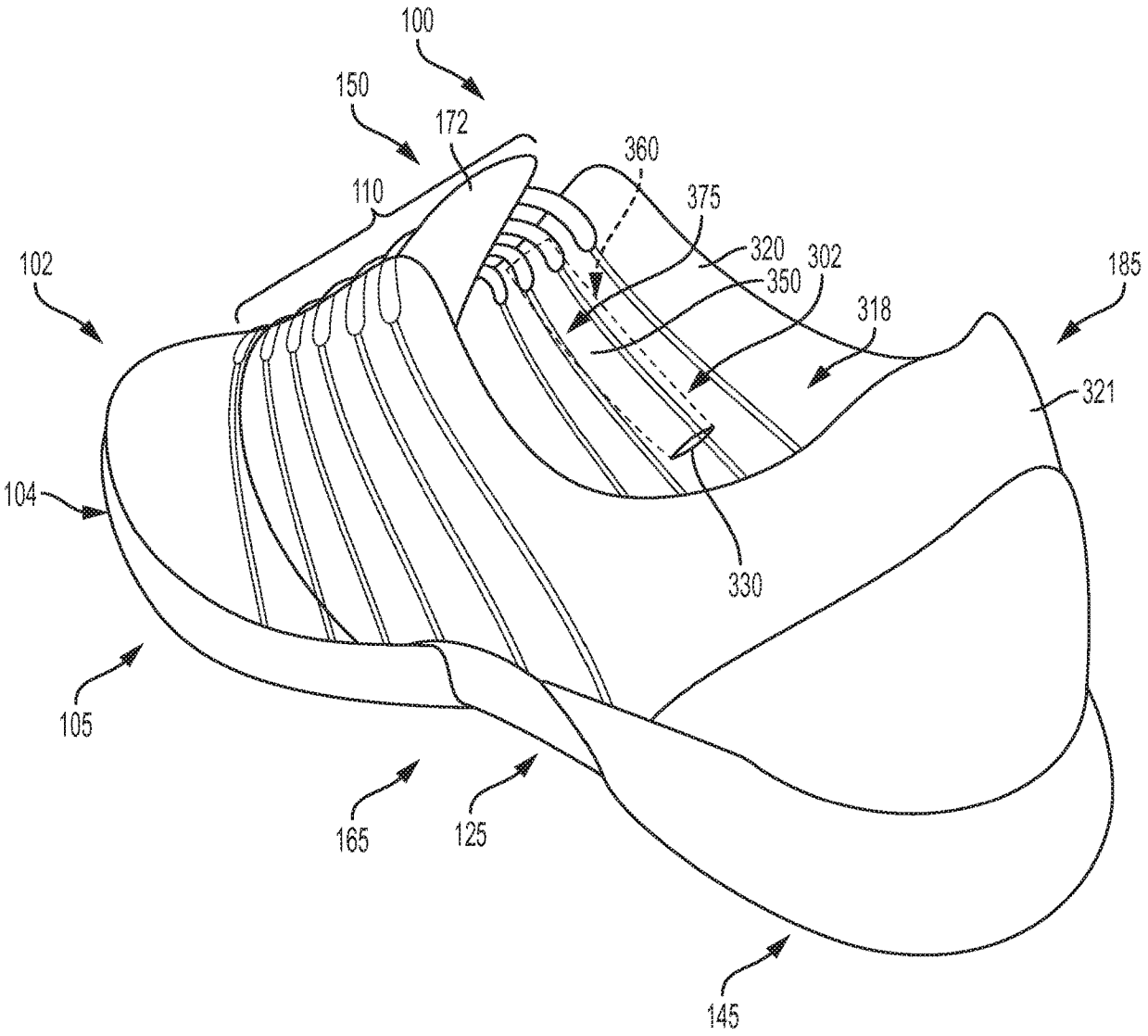
FIG. 3 is a schematic isometric view of an embodiment of an article of footwear with a compartment.
Figure 4:
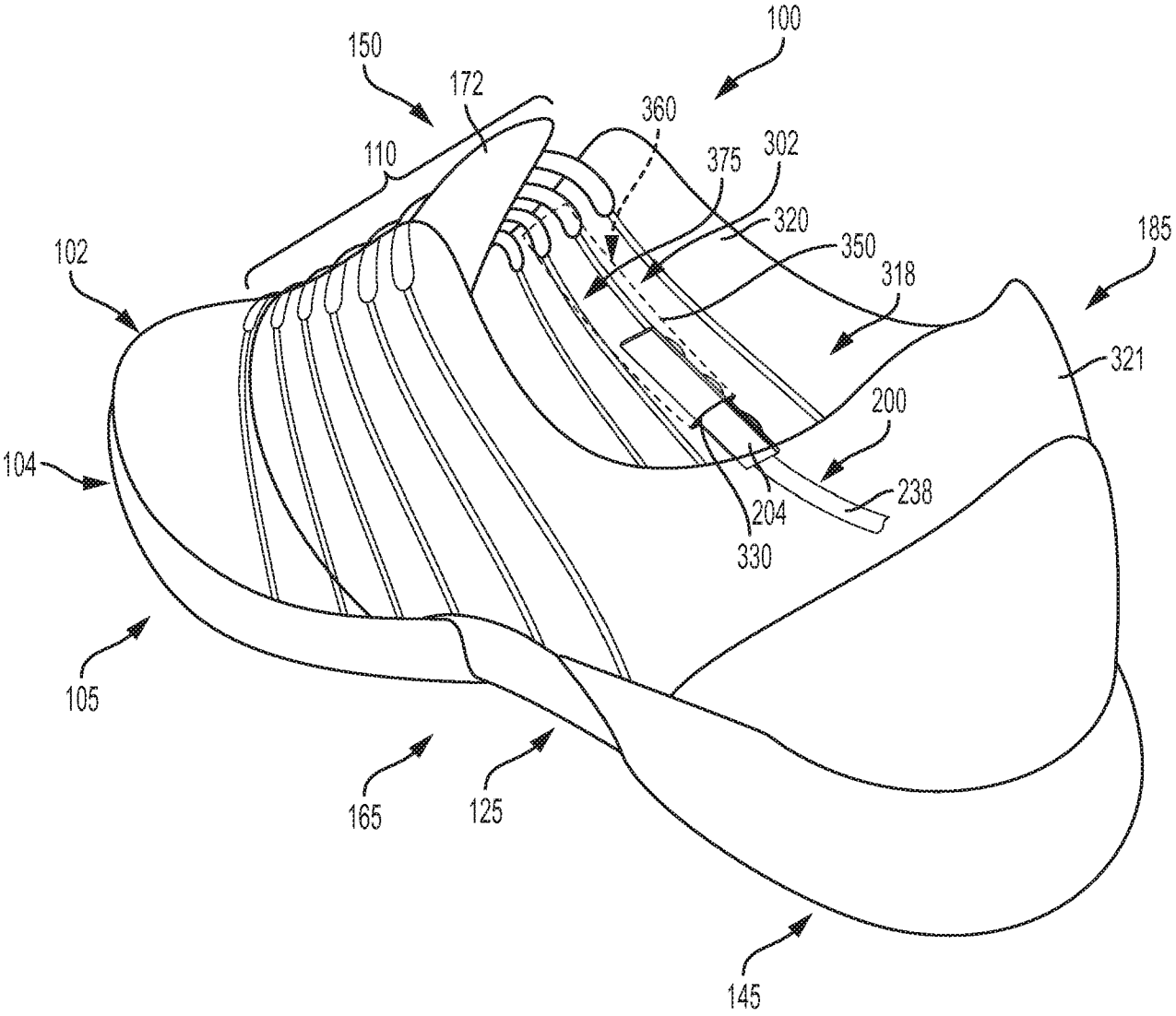
FIG. 4 is a schematic isometric view of an embodiment of an article of footwear with a compartment and a control device.

Referring to FIGS. 3-4, a portion of article 100 associated with heel region 145 is depicted, providing reader with a view of an interior void 318 within upper 102. In some embodiments, upper 102 may include a compartment, as described above. An embodiment of a compartment 302, disposed within a portion of upper 102, is shown with dotted lines in FIGS. 3-4. In one embodiment, compartment 302 may be formed between two or more layers of upper 102.

In addition, as shown in FIG. 3-6, in some embodiments, upper 102 may include two sides, where each side represent generally opposing sides of upper 102. For example, there may be an outer surface 321 of upper 102, where outer surface 321 is disposed to form at least a portion of the external (outward facing) surface of upper 102. Furthermore, there may be an inner surface 320 of upper 102, where inner surface 320 is the surface of upper 102 that is facing toward a foot when a foot is disposed within interior void 318. It should be understood that there may be one or more layers of material disposed between outer surface 321 and inner surface 322 in different embodiments.

In some embodiments, compartment 302 may comprise a sleeve-like region disposed along a portion of upper 102. Compartment 302 may be at least partially bounded by one or more upper layers that together form a tunnel 375. It should be understood that compartment 302 may additionally include a slot 330 that can provide access to the interior of tunnel 375. In one embodiment, slot 330 may be secured or substantially closed after insertion of a component, such as control device 200 of FIG. 2.

In some embodiments, tunnel 375 may be formed between a first layer 350 and a second layer 360 of upper 102. In some embodiments, first layer 350 may comprise the innermost layer of upper 102 (i.e., inner surface 320). In some embodiments, second layer 360 could comprise the outermost layer of upper 102 (i.e., outer surface 321). However, in other embodiments, first layer 350 and/or second layer 360 may be disposed adjacent to additional layers of upper 102. Thus, in some embodiments, first layer 350 may not comprise the innermost layer of upper 102. Similarly, second layer 360 may not comprise the outermost layer of upper 102 in some embodiments. In other words, in different embodiments, upper 102 may have a compartment that may be disposed in different regions and comprising different materials.

Referring to FIG. 4, in different embodiments, article 100 can include various components, devices, or elements that may be used in conjunction with control device 200. In other words, control device 200 may be configured to operate as a part of a tensioning system and/or connect with additional components that are associated with article 100. For example, as noted above, article 100 may include various mechanical or electronic contacts disposed throughout one or more regions of article 100. Thus, in some embodiments, prior to or after insertion of control device 200 in compartment 302, control device 200 may be joined or attached or otherwise linked to connecting elements. In some cases, port 230 (see FIG. 2) may form a connection with one or more connecting elements in article 100. However, it should be understood that installation of control device 200 may also occur without any prior connection or later connection to an element of article 100.

As shown in FIG. 4, in some embodiments, at least a portion of control device 200 may be readily slid or inserted into tunnel 375 of upper 102 without requiring the removal of or damage to various layers of upper 102. In some embodiments, this process may be facilitated by the inclusion of slot 330, which can be sized to accommodate the entry of one end of control device 200. Once panel 204 has been inserted, it can be guided through the length of tunnel 375. In different embodiments, the length or other dimensions of tunnel 375 may be adjusted or configured for accommodating control device 200 and/or allowing insertion of control device 200 in a manner that does not interfere with the comfort of the article for a user.

In some embodiments, as noted above with respect to FIG. 2, first hole 222 and/or second hole 224 may be used with other elements or components (such as a guiding cable, loop, or hook) to move panel 204 toward a location more proximate to throat opening 132. Upon reaching the desired position of panel 204, hook portions 216 (see FIG. 2) may be used to anchor or secure control device 200. For example, first hook portion 218 and/or second hook portion 220 (shown in FIG. 2) may contact a portion of upper 102 and, due to the curvature of hook portions 216, snag or otherwise connect with a portion of upper 102.

It should be understood that in some embodiments, panel 204 may be disposed along either medial side 165 or lateral side 185 of upper 102. Furthermore, in other embodiments, panel 204 may be disposed in a manner that extends along both medial side 165 and lateral side 185, and can be located in any of forefoot region 105, midfoot region 125, and heel region 145.

Figure 5:
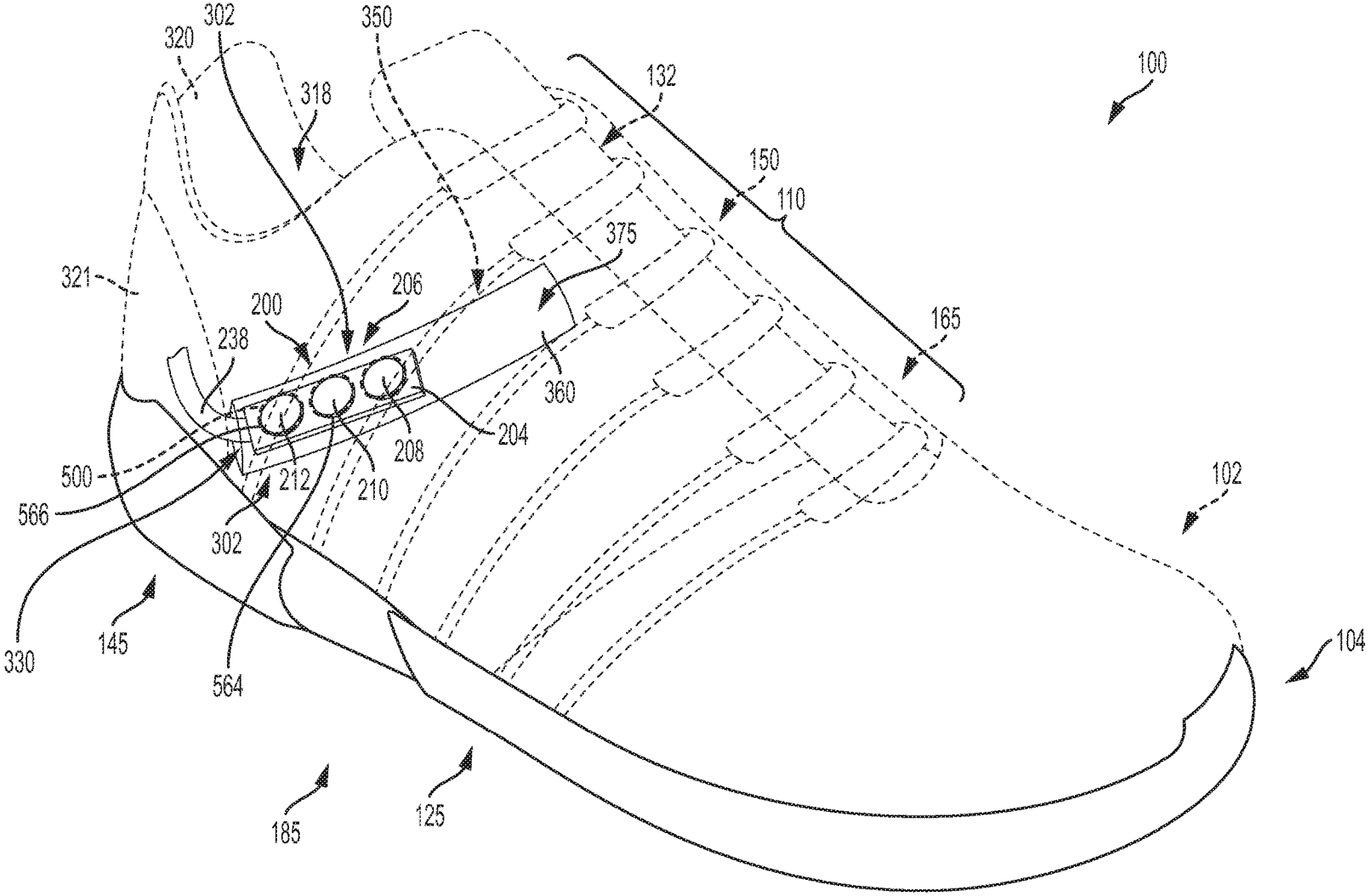
FIG. 5 is a schematic isometric view of an embodiment of an article of footwear with a compartment and a control device.
Figure 6:
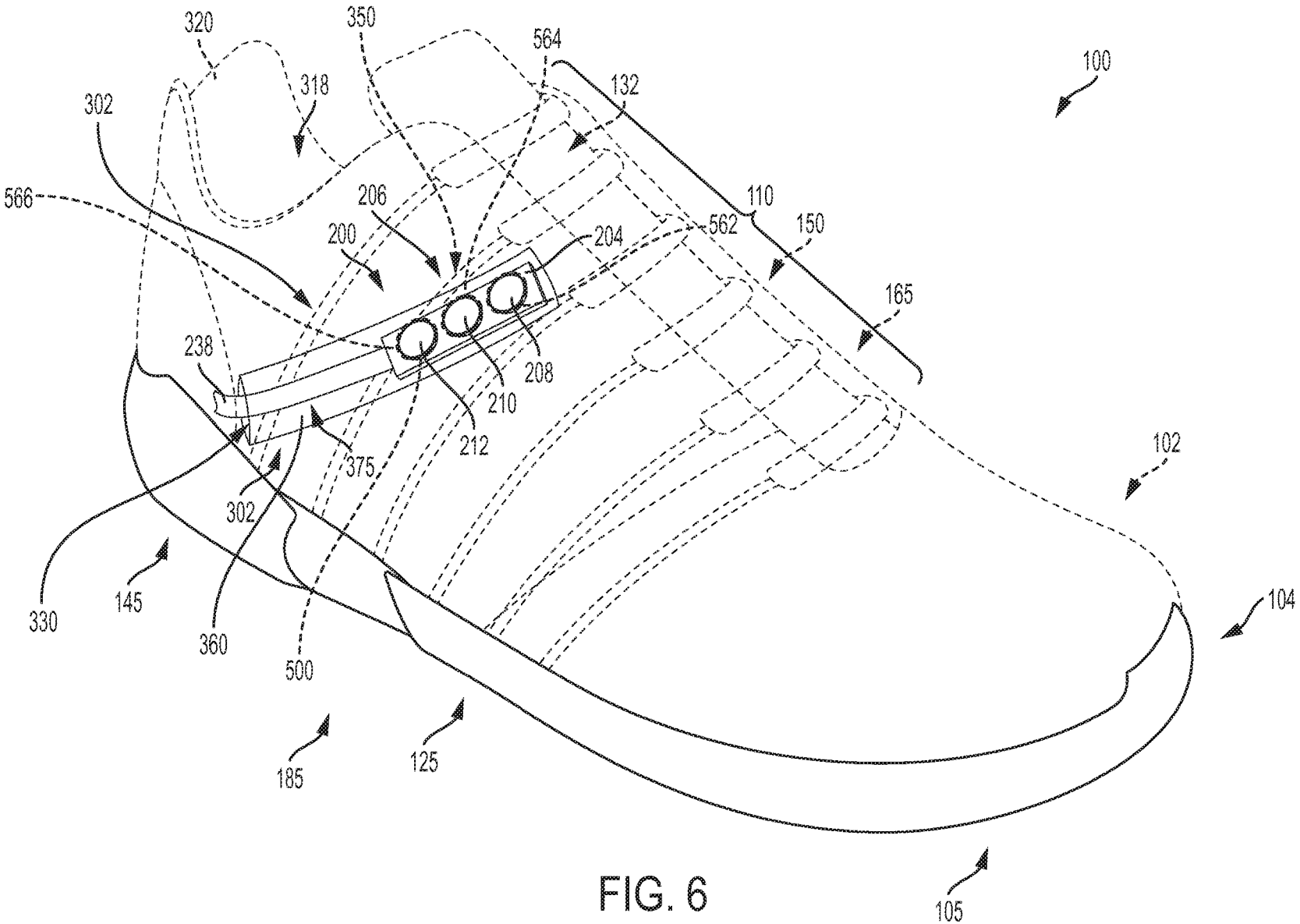
FIG. 6 is a schematic isometric view of an embodiment of an article of footwear with a compartment and a control device.

In order to provide the reader with greater understanding of the proposed embodiments, an additional view of the installation process is depicted in FIGS. 5 and 6. In FIGS. 5 and 6, two isometric side views of upper 102 are shown. Upper 102 is illustrated by a series of dotted lines, while compartment 302 is shown in solid lines. As noted above, in some embodiments, the dimensions of tunnel 375 may be designed or configured for secure and/or snug receipt of control device 200. In FIG. 5, tunnel 375 generally includes a diameter greater than panel width 240 (see FIG. 2) of panel 204. Furthermore, panel length 242 as indicated in FIG. 2 may be less than a length associated with tunnel 375. In other words, tunnel 375 may be dimensioned to at least partially encompass or hold at least a portion of control device 200. In some embodiments, for example, the length of tunnel 375 may be only slightly larger than panel length 242, such that a substantially snug fit is formed between panel 204 and tunnel 375. However, in other embodiments, dimensions of either control device 200 or compartment 302 may differ such that one is substantially different from the other. For example, depending on the length and size of the portion of sheath 238 that is incorporated into upper 102, tunnel 375 can be extended to accommodate the wiring associated with control device 200.

In some embodiments, it may be possible to configure upper 102 in a manner that allows control device 200 to more readily be utilized by a user upon installation. In some embodiments, compartment 302 may include provisions for allowing access to the buttons or other control mechanisms associated with control device 200. In FIGS. 5 and 6, for example, apertures 500 can be seen formed in upper 102 along instep region 110. Apertures 500 include a first aperture 562, a second aperture 564, and a third aperture 566 are depicted. In some embodiments, when control device 200 is installed in upper 102, first aperture 562 may be aligned with first button 208, second aperture 564 may be aligned with second button 210, and third aperture 566 can be aligned with third button 212. Thus, when panel 204 is positioned to correspond with apertures 500, at least a portion of first button 208 is exposed through the opening provided by first aperture 562, at least a portion of second button 210 is exposed through the opening provided by second aperture 564, and at least a portion of third button 212 is exposed through the opening provided by third aperture 566. In other words, portions of upper 102 associated with compartment 302 may include exposed areas or gaps that allow contact with at least a portion of installed components. Thus, in different embodiments, panel 204 can be disposed in compartment 302 in a way that is compatible or consistent with the provisions manufactured provisions included throughout article 100 that can permit interaction with control device 200 by a user. Furthermore, the alignment of buttons 206 may facilitate the installation of additional components or elements along control device 200, as will be discussed below with respect to FIGS. 7-10.

Figure 7:
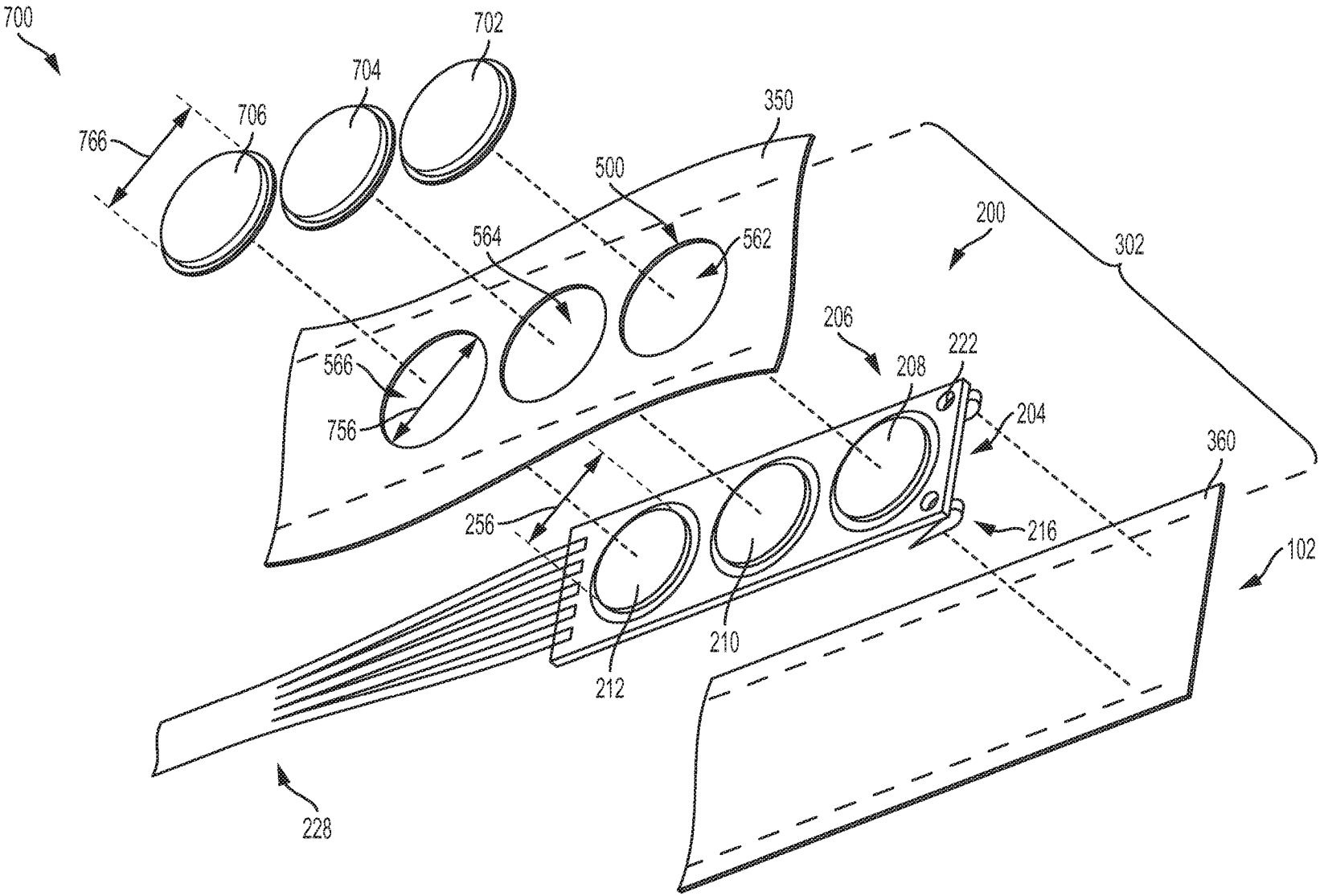
FIG. 7 is a schematic exploded view of an embodiment of a control device in a compartment.
Figure 8:
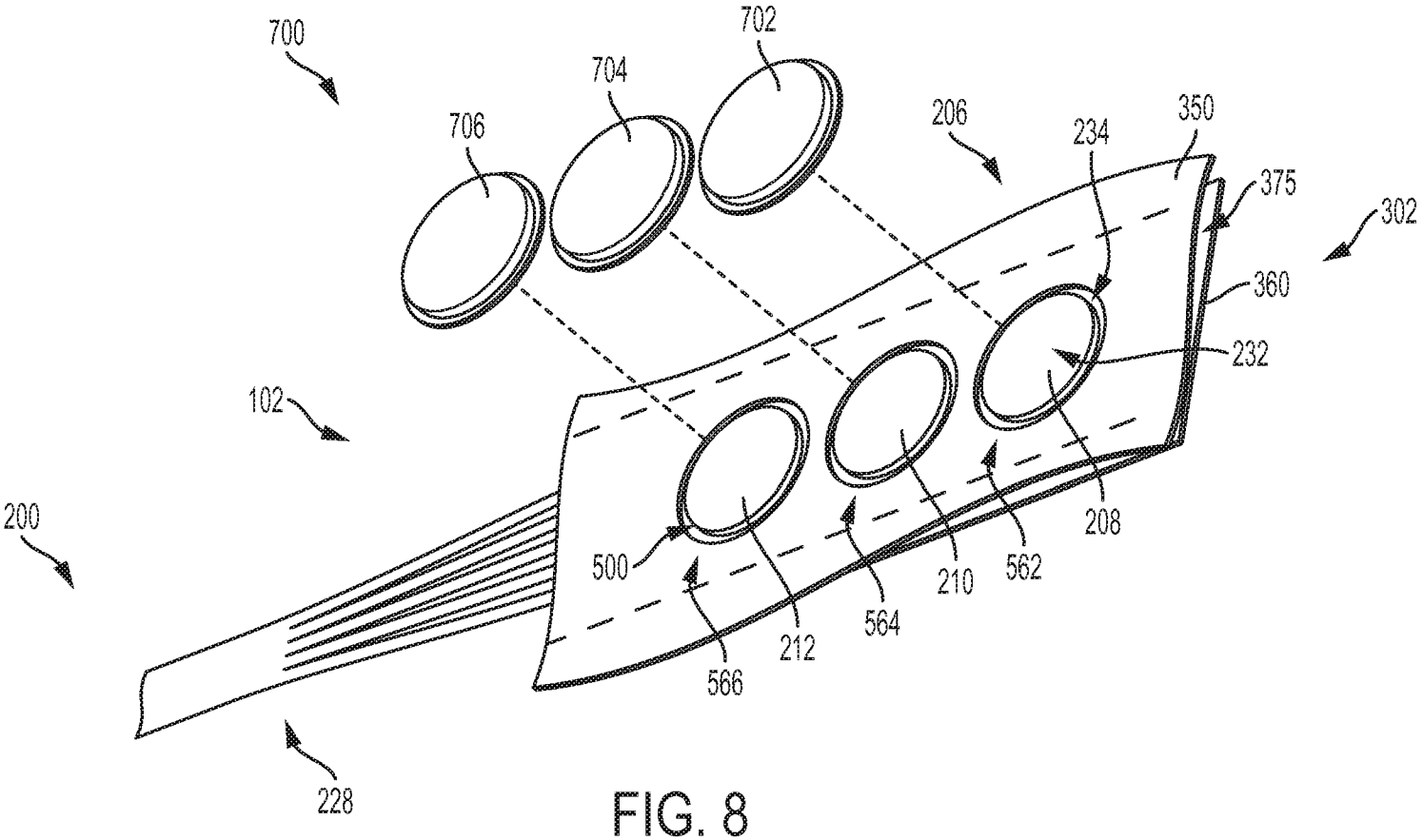
FIG. 8 is a schematic isometric view of an embodiment of a control device in a compartment with covers.

Referring now to FIG. 7, an exploded isometric view of a portion of control device 200 within a portion of upper 102 (specifically, a portion of upper 102 associated with compartment 302) is shown. In FIGS. 7 and 8, the portion of compartment 302 comprising tunnel 375 is illustrated by a series of dotted lines along first layer 350 and second layer 360. Panel 204 with buttons 206 is shown disposed between first layer 350 and second layer 360.

In different embodiments, control device 200 may be associated with additional elements that can provide increased protection, durability, usability, comfort, aesthetics, and/or functioning to control device 200. For example, one or more buttons 206 may be joined to a coating, lid, cover, cap, shield, veneer, or other type of layer. In one embodiment, a cover may be installed, joined to, or disposed over buttons 206. In FIG. 7, a series of covers 700 are depicted, including a first cover 702, a second cover 704, and a third cover 706. In some embodiments, covers 700 may be substantially similar in shape to buttons 206. However, in other embodiments, covers 700 may be shaped differently depending on the functionality and/or appearance desired.

Formed in some areas of first layer 350 are apertures 500, as described with respect to FIGS. 5 and 6. It can be seen that prior to assembly, covers 700, apertures 500, and buttons 206 can be arranged such that they are generally aligned with one another. Specifically referring to FIG. 7, first button 208, first aperture 562, and first cover 702 are generally aligned, second button 210, second aperture 564, and second cover 704 are aligned, and third button 212, third aperture 566, and third cover 706 are aligned.

Furthermore, the sizes of each aligned cover, aperture, and button may be correlated and/or can substantially match in some embodiments. In other words, control device 200, upper 102, and elements such as covers 700 may include dimensions that allow greater ease of installation in the article. For example, in FIG. 7, third button 212 is associated with third diameter 256, third aperture 566 is associated with an aperture diameter 756, and third cover 706 is associated with a cover diameter 766. In some embodiments, each diameter can be selected to allow increased fit between components, and/or streamline the assembly process with the article. Thus, as shown in FIG. 7, third diameter 256 can be smaller than cover diameter 766, such that third cover 706 may encompass the entirety of third button 212. Furthermore, cover diameter 766 may be smaller than aperture diameter 756 in some embodiments, such that third cover 706 may be readily inserted into third aperture 566. However, in other embodiments, aperture diameter 756 may be smaller than cover diameter 766, allowing a more snug or secure fit between third cover 706 within upper 102 when third cover 706 is joined to third button 212. Similarly, third diameter 256 of third button 212 can be greater than either cover diameter 766 or aperture diameter 756 in some embodiments.

In different embodiments, covers 700 may be applied to control device 200 after insertion and/or incorporation of panel 204 within upper 102. For example, referring to FIG. 8, panel 204 is shown installed within compartment 302. Panel 204 has been inserted within tunnel 375, where tunnel 375 is formed of a portion of first layer 350 and second layer 360 joined together along the region depicted with dotted lines. The portions of buttons 206 associated with inner portion 232 are visible through apertures 500, as well as some portions associated with outer portion 234. Thus, first button 208 is at least partially exposed through first aperture 562, second button 210 is at least partially exposed through second aperture 564, and third button 212 is at least partially exposed through third aperture 566. Furthermore, first cover 702 is shown above panel 204, generally aligned with first aperture 562, second cover 704 is shown above panel 204, generally aligned with second aperture 564, and third cover 706 is shown above panel 204, generally aligned with third aperture 566.

Figure 9:
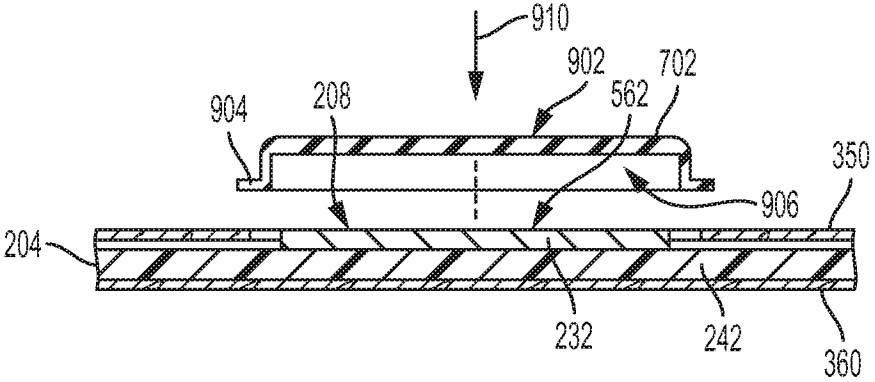
FIG. 9 is a cross-sectional side view of an embodiment of a control device interface.
Figure 10:
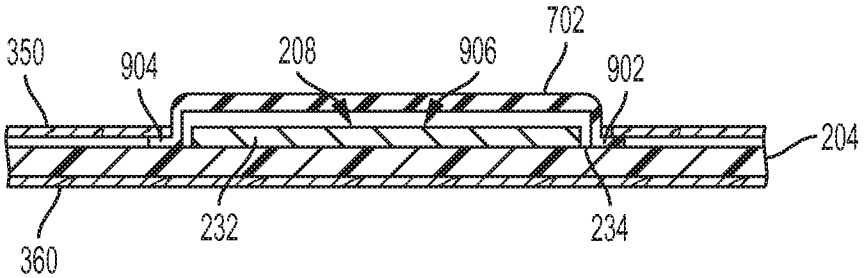
FIG. 10 is a cross-sectional side view of an embodiment of a control device interface.

In order to better illustrate the installation of covers 700 along panel 204, FIGS. 9 and 10 depict a side-view cross-section of first cover 702 and first button 208 in panel 204. In FIG. 9, first cover 702 is shown above first button 208 prior to installation. First cover 702 includes a central portion 902 and a rim portion 904. Central portion 902 may be bordered by rim portion 904 in some embodiments. Furthermore, rim portion 904 may be disposed around central portion 902 to form a recess 906 within first cover 702. As first cover 702 is inserted into first aperture 562, rim portion 904 may contact first layer 350. As a force 910 is applied to push and connect first cover 702 with control device 200, rim portion 904 may flex, bend, or otherwise deform in order to enter first aperture 562.

Referring to FIG. 10, it can be seen that first cover 702 has been installed over first button 208. Rim portion 904 may contact a portion of first button 208 in some embodiments. In other embodiments, rim portion 904 may contact a portion of first layer 350 and/or second layer 360. Thus, in one embodiment, a force may be applied in order to mechanically join first cover 702 with first button 208. In different embodiments, any other means of installing or joining covers with panel 204 may be utilized, including bonding, adhesive, chemical molding, welding, stitching, or any other means. Furthermore, it should be understood that in other embodiments, buttons may be manufactured with covers pre-installed, such that covers are joined to buttons prior to insertion of control device 200 in an article.

Figure 11:
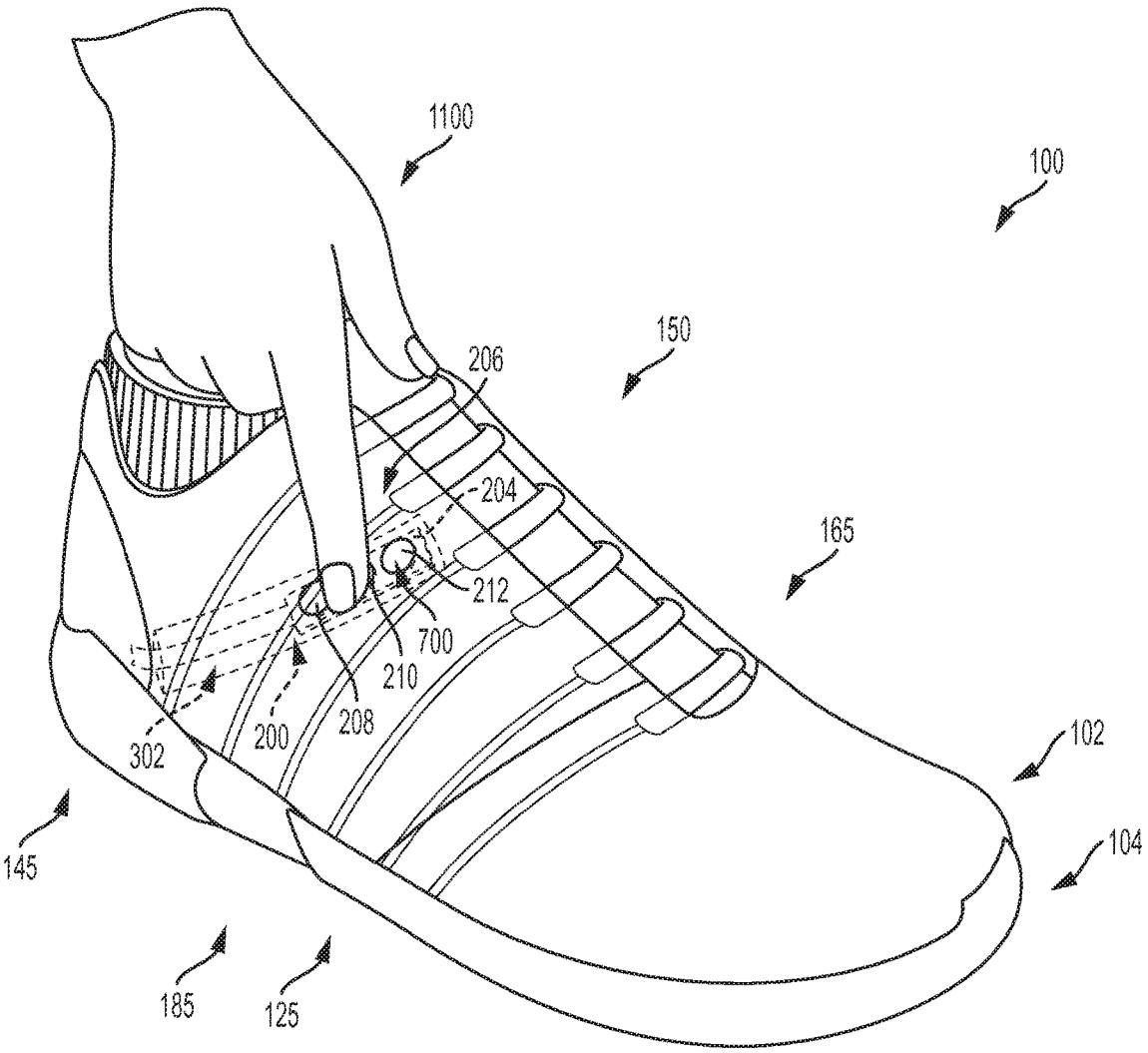
FIG. 11 is schematic isometric side view of an embodiment of an article of footwear.

Referring now to FIG. 11, article 100 is illustrated with control device 200 installed. In FIG. 11, upper 102 and sole structure 104 of article 100 are depicted in solid line, while control device 200 and compartment 302 are depicted in dotted lines. A user 1100 may be able to utilize control device 200 to interact, engage, operate, and/or activate various functions of article 100. In some embodiments, functions can include different aspects of tensioning system 150, as described with respect to FIG. 1. In order to interact with control device 200, user may contact and/or exert a force against a portion of panel 204. In FIG. 11, index finger of user 1100 is being applied to second button 210.

Figure 12:
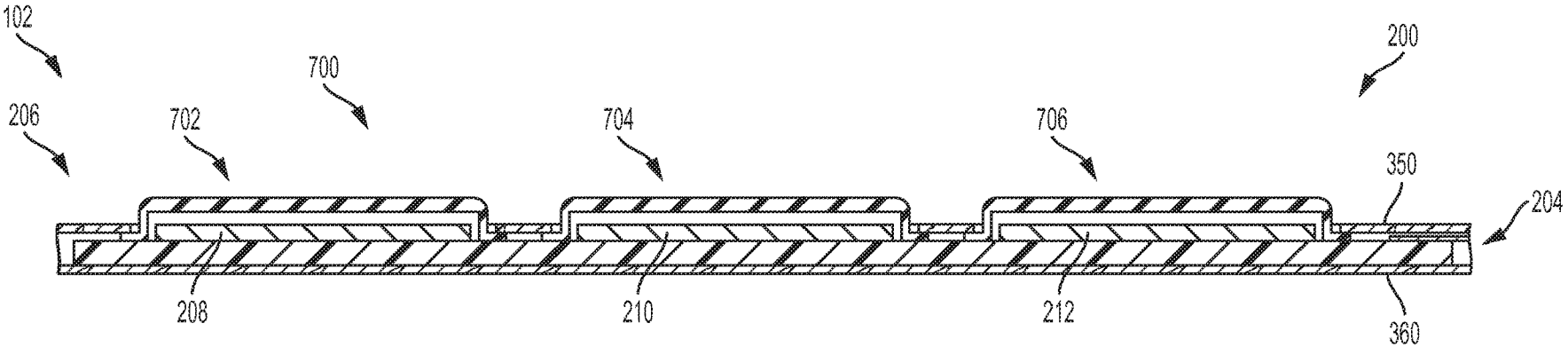
FIG. 12 is a cross-sectional side view of an embodiment of a control device interface.
Figure 13:
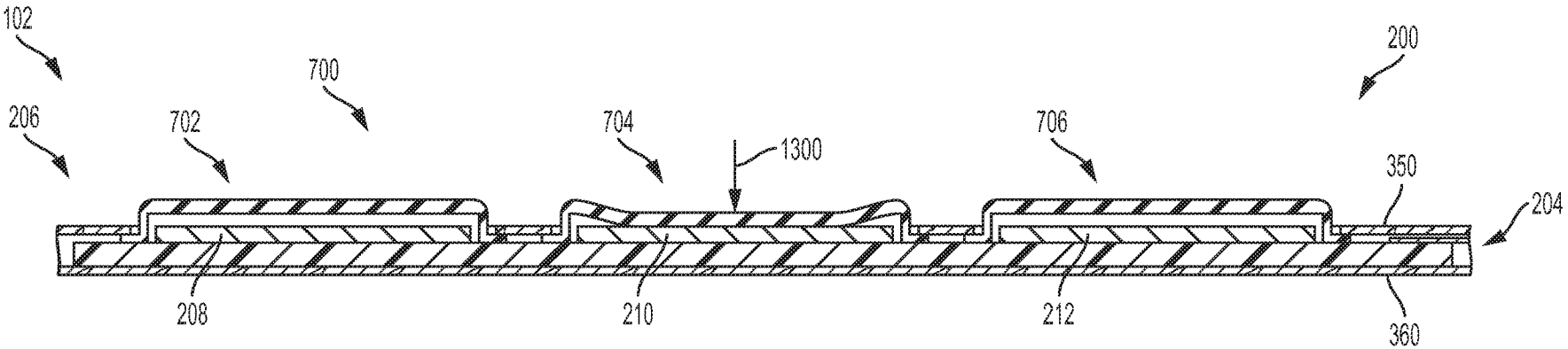
FIG. 13 is a cross-sectional side view of an embodiment of a control device interface.

In FIG. 12, a side-view cross-section of an embodiment of panel 204 of control device 200 as installed in upper 102 is depicted, showing buttons 206 with corresponding covers 700. Referring now to FIG. 13, as a force 1300 is applied to second cover 704, the surface of second cover 704 may deform. As a result of the deformation, a portion of second cover 704 can contact a portion of second button 210. Contact between second cover 704 and second button 210, and/or the pressure exerted by force 1300, can elicit a signal or otherwise produce a change within elements of panel 204 that is recognized by control device 200 or other systems. Thus, in some embodiments, buttons 206 can be used by a person to interact with control device 200 and the systems associated with control device 200.

In different embodiments, when user 1100 engages with control device 200, a variety of different operations may be activated or disabled. Throughout the detailed description and in the claims, various operating modes, or configurations, of a tensioning system are described for purposes of illustration. These operating modes may refer to states of the tensioning system itself, as well as to the operating modes of individual subsystems and/or components of the tensioning system. Exemplary modes include an "incremental tighten mode", an "incremental loosen mode" and a "fully loosen" mode. The latter two modes may also be referred to as an "incremental release mode" and a "full release mode". In the incremental tighten mode, a tensioning system may operate in a manner that incrementally (or gradually) tightens, or increases the tension of a lace or other tensile element. In the incremental loosen mode, a motorized tightening device may operate in a manner that incrementally (or gradually) loosens, or releases tension in the tensile element(s). In the full release mode, a tensioning system may operate in a manner so that tension applied to the lace by the system is substantially reduced to a level where the user can easily remove his or her foot from the article. This is in contrast to the incremental release mode, where the system operates to achieve a lower tension for the tensile element relative to the current tension, but not necessarily to completely remove tension from the tensile elements. Moreover, while the full release mode may be utilized to quickly release lace or tensile element tension so the user can remove the article, the incremental release mode may be utilized to make minor adjustments to the lace tension as a user searches for the desired amount of tension. Other operating modes may also be possible.

Referring again to FIGS. 11-13, in some embodiments, user 1100 may use control device 200 to initiate control commands. Some examples of control commands may include, but are not limited to, left/right shoe selection, incremental tighten, incremental loosen, open/fully loosen, store tension, and recall/restore tension. For example, in one embodiment, first button 208 and second button 210 can be used to select the article of footwear (i.e., left or right) that will receive and respond to the control commands. In some embodiments, either first button 208 or second button 210 may be selected, but both may not be selected simultaneously. In other cases, it may be possible to select both first button 208 and second button 210 simultaneously, to allow a user to tighten, loosen, open both articles simultaneously, or initiate some other function. In another example, third button 212 can be used for initiating an "incremental tighten" command of tensioning system 150.

In some embodiments, control device 200 may also include provisions for storing and using preferred tension settings. In one embodiment, first button 208 may be used to initiate a "store current tension" command and/or a "return to stored tension" command, depending on the duration that first button 208 is pressed, for example. Still other embodiments could include provisions for storing multiple tension settings. For example, a user may prefer a tighter fit for playing sports and a looser fit for casual activities. In such cases, control device 200 may allow a user to store two or more tension settings, corresponding to at least two different lace tension preferences. Those skilled in the art appreciate that storage or recall of tensions for tensioning system 150, whether part of a single item or multiple items, such as a pair of shoes, may be performed with a single command issued by a control device 200 or with a series of control commands.

In some cases, this incremental loosening or tightening of article 100 can occur in discrete steps so that each time the wearer presses a button (for example, first button 208), the tensile elements are let out up by a predetermined amount (for example by rotating a spool within a motorized tensioning device through a predetermined angle). In other cases, this incremental loosening can occur in a continuous manner, as long as the wearer continues to touch first button 208. In some cases, the speed of loosening can be set so that the system does not overshoot a preferred level of tightness (i.e., the system doesn't move between too tight and not tight enough too quickly) while also being large enough to avoid overly long times for fully loosening article 100. With this arrangement, user 1100 can continue increasing and decreasing the tension throughout article 100 (using the incremental tighten and incremental loosen modes) until a preferred level of tightness for upper 102 is achieved.

In different embodiments, any of the components described herein could be disposed in any other portions of an article, including various regions of the upper and/or sole structure. In some cases, some component parts (such as lead wires, etc.) could be disposed in one portion of an article and other component parts (such as the panel, etc.) could be disposed in another, different, portion. The location of one or more component parts may be selected according to various factors including, but not limited to: size constraints, manufacturing constraints, aesthetic preferences, optimal design and functional placement, ease of removability or accessibility relative to other portions of the article, as well as possibly other factors.

It should be understood that the embodiments and features described herein are not limited to a particular user interface or application for operating a motorized tensioning device or a tensioning system. Furthermore, the embodiments here are intended to be exemplary, and other embodiments could incorporate any additional control buttons, interface designs and software applications. The control buttons for initiating various operating commands can be selected according to various factors including: ease of use, aesthetic preferences of the designer, software design costs, operating properties of the system, as well as possibly other factors. Furthermore, a variety of products, including apparel (e.g., shirts, pants, footwear), may incorporate an embodiment of the control device described herein, as well as other types of articles, such as bed coverings, table coverings, towels, flags, tents, sails, and parachutes, or articles with industrial purposes that include automotive and aerospace applications, filter materials, medical textiles, geotextiles, agrotextiles, and industrial apparel.

Although the control devices and methods of assembly and installation described herein may be utilized in a variety of products, the following discussion provides examples of other articles of apparel that incorporate a control device. That is, the following discussion with respect to FIGS. 14-16 demonstrates some ways in which a control device may be incorporated into a shirt 1400, a pair of pants 1500, and a glove 1600.

Figure 14:
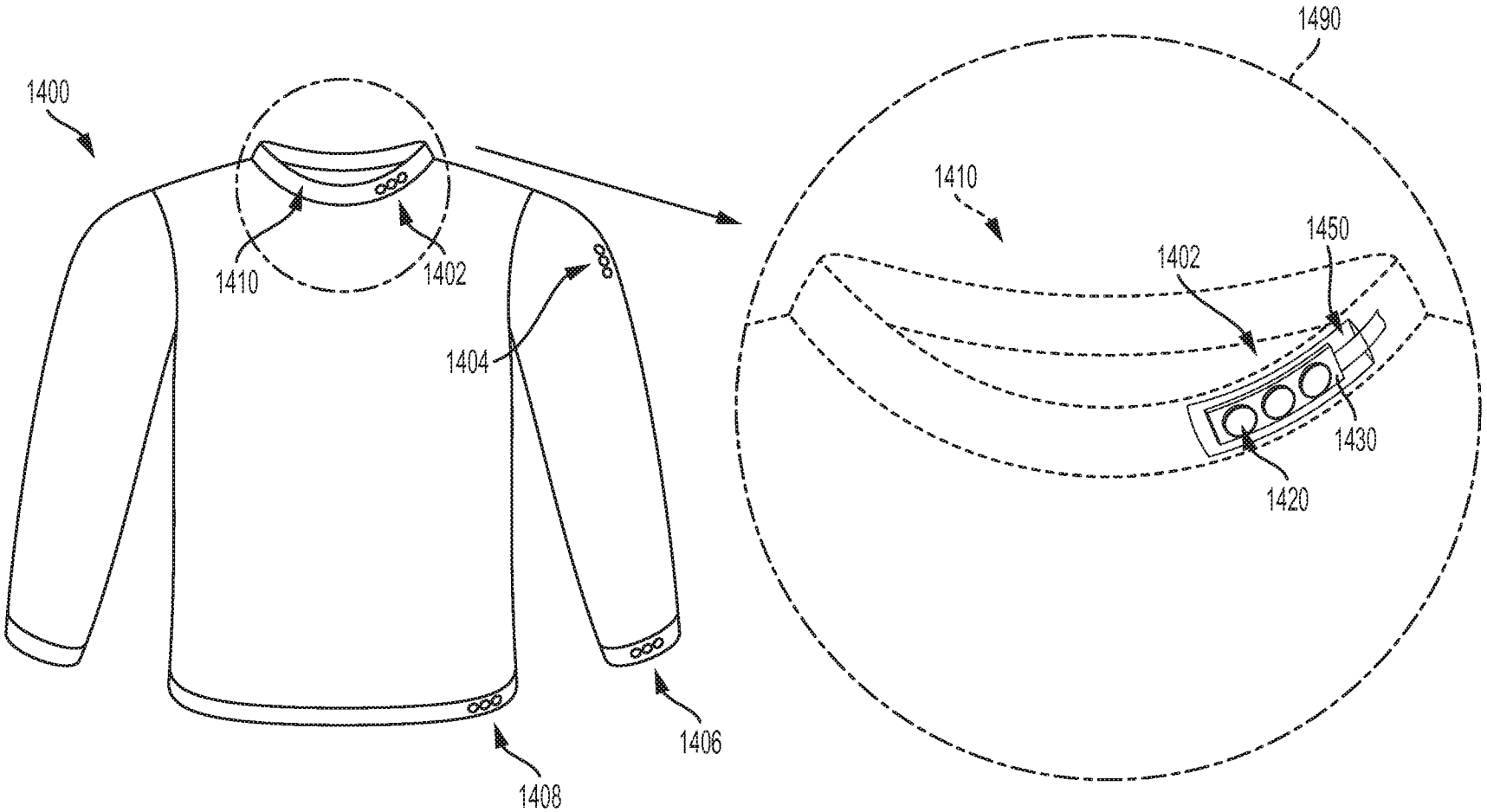
FIG. 14 is an isometric view of an article with a control device.

Referring to FIG. 14, in a first example, shirt 1400 is depicted. Shirt 1400 includes a first control device 1402, a second control device 1404, a third control device 1406, and a fourth control device 1408. For purposes of illustration, each control device is shown disposed in different regions of shirt 1400. In FIG. 14, as an example, first control device 1402 is located in a collar region 1410, second control device 1404 is located near a shoulder region, third control device 1406 is located along the edge of a sleeve, and fourth control device 1408 is located along the bottom edge of the torso of shirt 1400. To better illustrate the incorporation of a control device in shirt 1400, a magnified view 1490 of collar region 1410 is shown. In collar region 1410, first control device 1402 is shown within a first compartment 1450 formed within layers of the material comprising collar region 1410. Three buttons 1420 are visible, disposed along a panel 1430. Thus, a wearer of shirt 1400 may be able to access various control devices and easily interact with one or more buttons 1420. The control devices may connect with and/or operate various functions within shirt 1400, such as LEDs, temperature controls, tensile elements, and/or any other devices associated with shirt 1400, as well as other remote mechanisms (i.e., mechanisms that are not disposed within shirt 1400).

Figure 15:
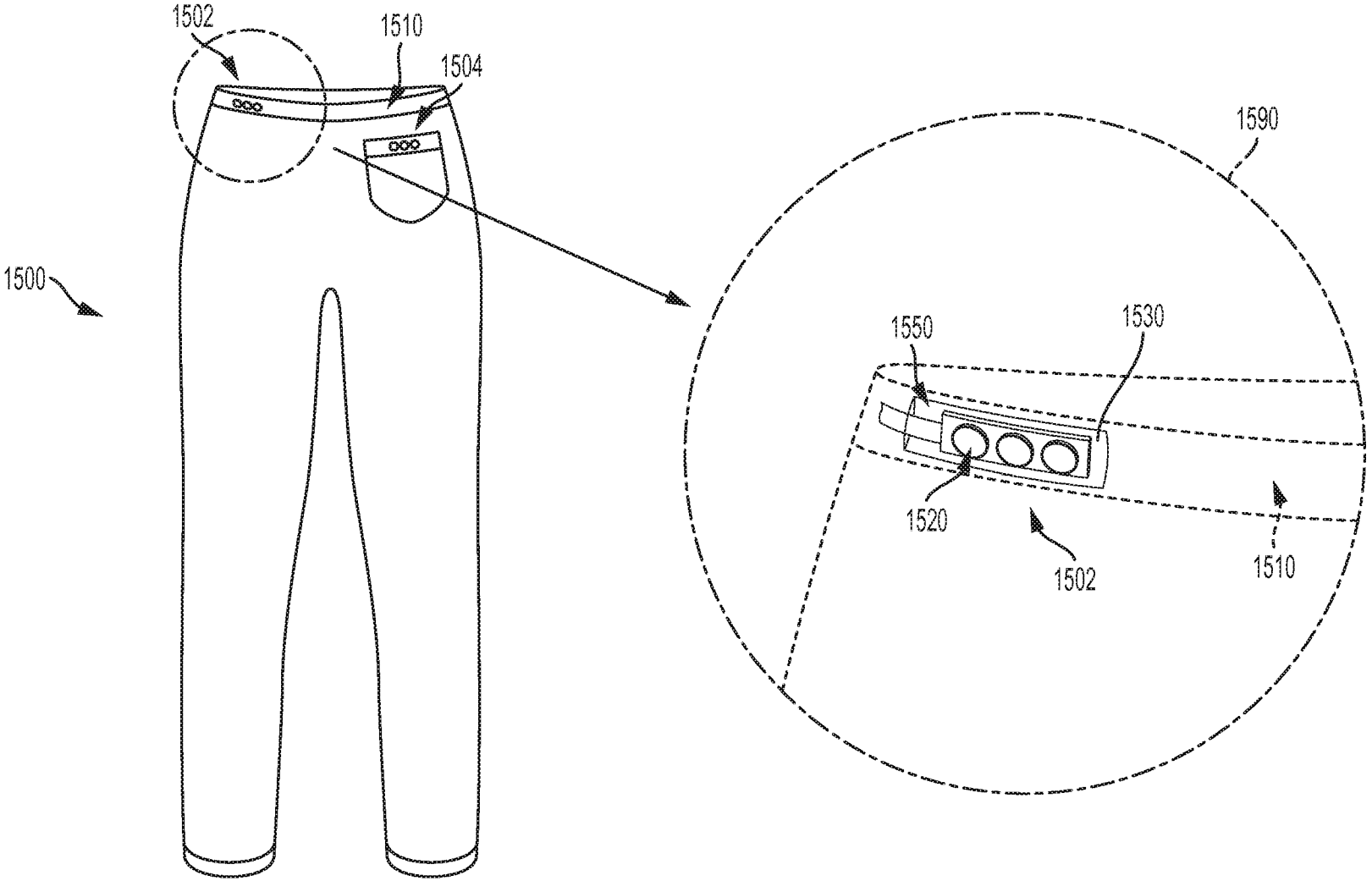
FIG. 15 is an isometric view of an article with a control device.

Referring now to FIG. 15, pants 1500 are depicted. Pants 1500 include a fifth control device 1502 and a sixth control device 1504. For purposes of illustration, each control device is shown disposed in different regions of pants 1500. In FIG. 15, as an example, fifth control device 1502 is located in a belt region 1510, and sixth control device 1504 is located along a pocket region. To better illustrate the incorporation of a control device in pants 1500, a magnified view 1590 of belt region 1510 is shown. In belt region 1510, fifth control device 1502 is shown within a second compartment 1550 formed within layers of the material comprising belt region 1510. Three buttons 1520 are visible, disposed along panel 1530. Thus, a wearer of pants 1500 may be able to access various control devices and easily interact with buttons 1520. Similar to shirt 1400 of FIG. 14, the control devices may connect with and/or operate various functions of systems associated with pants 1500, such as LEDs, temperature controls, tensile elements, and/or any other devices associated with pants 1500, as well as other remote mechanisms (i.e., mechanisms that are not disposed within pants 1500).

Figure 16:
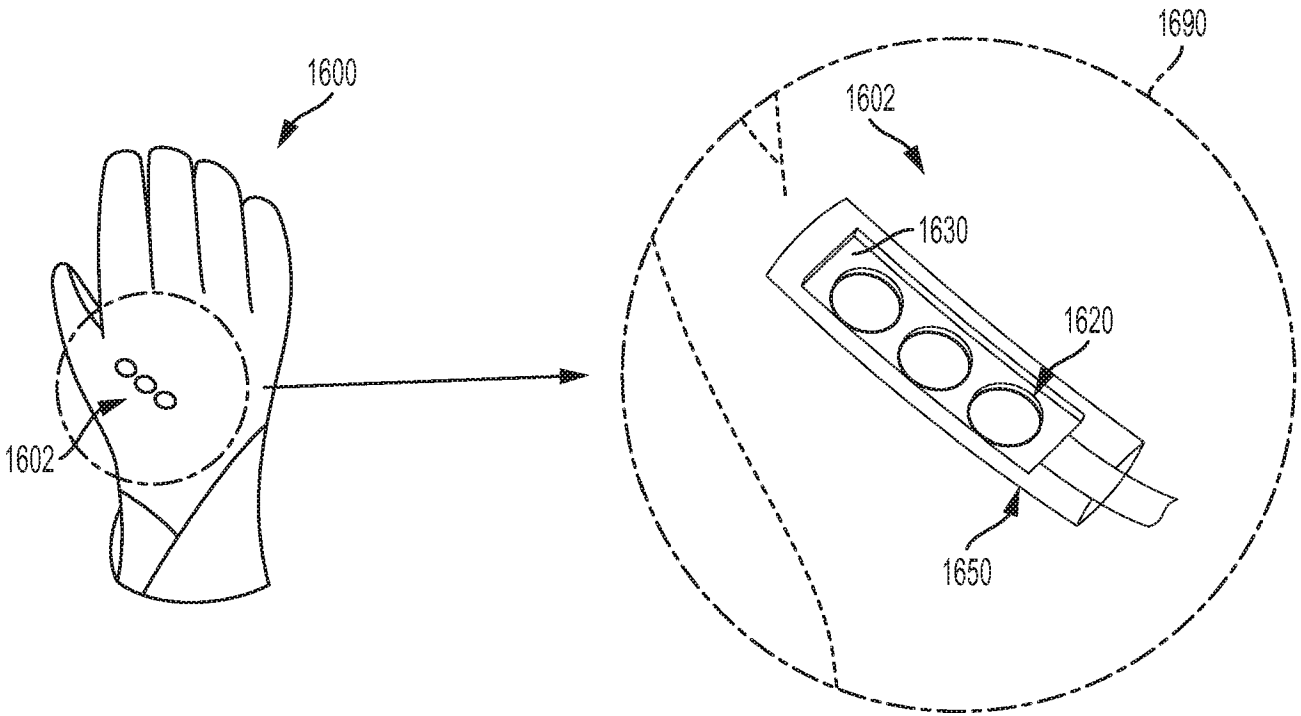
FIG. 16 is an isometric view of an article with a control device.

In other embodiments, control devices may be disposed in other articles. Referring to FIG. 16, a glove 1600 is depicted. Glove 1600 includes a seventh control device 1602. In FIG. 16, as an example, seventh control device 1602 is located along the upper portion of glove 1600 associated with the opisthenar (back of the hand), which may provide easy access by a corresponding (opposite) hand. To better illustrate the incorporation of a control device in glove 1600, a magnified view 1690 is included, showing seventh control device 1602 disposed within a third compartment 1650 formed within layers of the material comprising glove 1600. Three buttons 1620 are visible, disposed along a panel 1630. Thus, a wearer of glove 1600 may be able to access various control devices and easily interact with buttons 1620. Similar to shirt 1400 of FIG. 14 and pants 1500 of FIG. 15, the control devices may connect with and/or operate various functions within glove 1600, such as LEDs, temperature controls, tensile elements, and/or any other devices associated with glove 1600, as well as other remote mechanisms (i.e., mechanisms that are not disposed within glove 1600).

Figure 17:
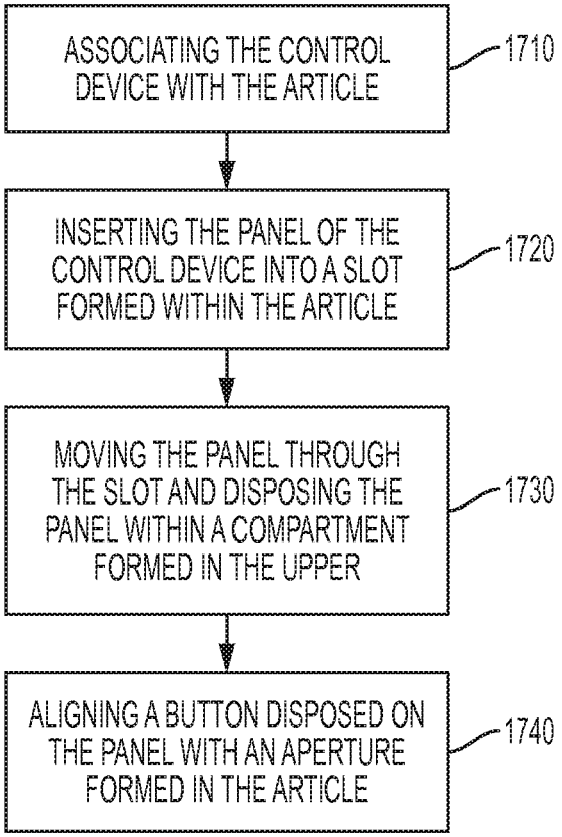
FIG. 17 is a flow chart depicting a method of installing a control device in an article.

It should be understood that the control devices depicted herein can be installed in different ways. For purposes of illustration, FIG. 17 provides a flow chart depicting one method of installing a control device in an article of footwear or an article of apparel. In one embodiment, the method of installation can include a first step 1710 of associating the control device with the article. In different cases, the article may be manufactured with a compartment, as discussed above. In a second step 1720, the panel of the control device can be inserted into a slot formed within a portion of the article. A third step 1730 can comprise moving the panel through the slot such that the panel is disposed within the compartment formed in the article. In a fourth step 1740, at least one button disposed on the panel can be aligned with at least one aperture formed on the upper. In other embodiments, other steps can include connecting a port of the control device with a connecting element in the article. In some embodiments, at least one button cover may also be installed on the panel. Furthermore, as discussed above, in some cases, the panel may be anchored or secured within the compartment using a hook portion that is formed along the panel. In other embodiments, moving the panel through the slot further comprises grasping a hole formed in the panel and guiding the panel through the compartment using a tensile element (as discussed with reference to FIG. 2).

Furthermore, the embodiments described herein may also include or refer to techniques, concepts, features, elements, methods, and/or components from U.S. Patent Publication Number 2016-0345679 A1, published Dec. 1, 2016, (previously U.S. patent application Ser. No. 14/723,972, filed May 28, 2015), titled "An Article Of Footwear And A Method Of Assembly Of The Article Of Footwear,", U.S. Patent Publication Number 2016-0345653 A1, published Dec. 1, 2016 (previously U.S. patent application Ser. No. 14/723,832, filed May 28, 2015), titled "A Lockout Feature For A Control Device,", U.S. Patent Publication Number 2016-0345654, published Dec. 1, 2016, (previously U.S. patent application Ser. No. 14/723,880, filed May 28, 2015), titled "A Charging System for an Article of Footwear,", U.S. Patent Publication Number 2016-0345671 A1, published Dec. 1, 2016, now U.S. Pat. No. 9,894,954 which issued on Feb. 20, 2018, (previously U.S. patent application Ser. No. 14/723,994, filed May 28, 2015), titled "A Sole Plate for an Article of Footwear,".

While various embodiments have been described, the description is intended to be exemplary, rather than limiting and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An article of footwear, comprising:

an upper having a first surface and a second surface, a compartment being formed between the first and second surfaces, the first surface forming an aperture embedded in the first surface;

a sole structure coupled to the upper;

a power source; and a control device, operatively coupled to the power source, comprising a panel, the control device positioned within the compartment, the panel including an electronic button electrically coupled to the panel and aligned with and extending through the aperture.

2. The article of footwear of claim 1, wherein the first surface is an outermost surface of the upper.

3. The article of footwear of claim 1, wherein the compartment comprises a tunnel formed between the first surface and the second surface.

4. The article of footwear of claim 1, wherein the compartment further includes a slot, and wherein the slot is configured to receive at least a first edge of the panel.

5. The article of footwear of claim 1, further comprising a button cover disposed adjacent to the electronic button.

6. The article of footwear of claim 1, further comprising a motorized tensioning system, operatively coupled to the control device, wherein the control device is used to transmit commands to the motorized tensioning system.

7. The article of footwear of claim 1, wherein the compartment is located along an instep region of the upper.

* * * * *